US010982828B1

(12) United States Patent
Chen

(10) Patent No.: US 10,982,828 B1
(45) Date of Patent: Apr. 20, 2021

(54) ARTIFICIAL TREE WITH LED-BASED LIGHTING SYSTEMS

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 16/896,567

(22) Filed: Jun. 9, 2020

Related U.S. Application Data

(63) Continuation of application No. 15/683,639, filed on Aug. 22, 2017.

(Continued)

(51) Int. Cl.

| | |
|---|---|
| ***F21S 4/10*** | (2016.01) |
| ***F21V 25/12*** | (2006.01) |
| ***F21V 23/06*** | (2006.01) |
| ***F21V 33/00*** | (2006.01) |
| ***A47G 33/06*** | (2006.01) |
| ***H05B 45/40*** | (2020.01) |
| ***F21V 23/02*** | (2006.01) |

(Continued)

(52) U.S. Cl.

CPC ..... *F21S 4/10* (2016.01); *A47G 33/06* (2013.01); *A47G 33/08* (2013.01); *F21V 23/002* (2013.01); *F21V 23/02* (2013.01); *F21V 23/06* (2013.01); *F21V 25/12* (2013.01); *F21V 33/0004* (2013.01); *H05B 45/40* (2020.01); *A47G 2033/0827* (2013.01); *F21W 2121/04* (2013.01); *F21Y 2115/10* (2016.08)

(58) Field of Classification Search

CPC ..... F21W 2121/04; A47G 2033/0827; A47G 33/06; A47G 33/08; F21S 4/10; F21S 4/20; F21S 4/22; F21S 4/24; F21S 4/26; F21V 23/06; F21V 19/005; F21V 19/001

See application file for complete search history.

(56) References Cited

U.S. PATENT DOCUMENTS

| | | | |
|---|---|---|---|
| 2,201,045 | A | 5/1940 | Lundstrom |
| 2,857,506 | A | 10/1958 | Minteer |

(Continued)

FOREIGN PATENT DOCUMENTS

| | | | |
|---|---|---|---|
| CN | 200982547 | Y | 11/2007 |
| CN | 201121811 | Y | 9/2008 |

(Continued)

*Primary Examiner* — Jong-Suk (James) Lee
*Assistant Examiner* — James M Endo
(74) *Attorney, Agent, or Firm* — Christensen, Fonder, Dardi & Herbert PLLC

(57) ABSTRACT

A multi-sectional artificial tree with a tree lighting system. The tree includes a DC power converter, and lower and upper tree sections. Each tree section includes a tree frame with groups of branches and light sets in a ratio of one light set per branch. The thin, single-conductor wires of each light set are affixed only to a single branch to prevent bending and breaking. Each group of branches and light sets is positioned at a particular height on the trunk of the tree. An upper tree section includes fewer branches per group, as compared to a lower section, and thus includes fewer light sets per group. The light sets are wired in series from branch-to-branch, though the number of light sets per group varies from section to section. Consequently, a resistive load is used in the upper tree section to adjust a voltage applied to individual light sets.

20 Claims, 19 Drawing Sheets

Related U.S. Application Data

(60) Provisional application No. 62/466,547, filed on Mar. 3, 2017, provisional application No. 62/466,646, filed on Mar. 3, 2017, provisional application No. 62/377,848, filed on Aug. 22, 2016.

(51) Int. Cl.

| | |
|---|---|
| ***F21V 23/00*** | (2015.01) |
| ***A47G 33/08*** | (2006.01) |
| ***F21Y 115/10*** | (2016.01) |
| ***F21W 121/04*** | (2006.01) |

(56) References Cited

U.S. PATENT DOCUMENTS 3,603,780 A 9/1971 Lu
3,617,732 A 11/1971 Fisher
3,970,834 A * 7/1976 Smith ..... A47G 33/06 362/123
3,985,924 A 10/1976 Pritza
4,020,201 A 4/1977 Miller
4,140,823 A 2/1979 Weskamp
4,161,768 A 7/1979 Gauthier et al.
4,675,575 A 6/1987 Smith et al.
4,870,547 A 9/1989 Crucefix
5,091,834 A 2/1992 Kao et al.
5,106,306 A 4/1992 Ditzig
5,639,157 A * 6/1997 Yeh ..... F21S 4/10 362/123
5,700,081 A 12/1997 Mengle et al.
5,776,559 A 7/1998 Woolford
5,834,901 A 11/1998 Shen
5,855,705 A * 1/1999 Gauthier ..... A47G 33/06 156/61
5,860,731 A 1/1999 Martinez
5,975,717 A 11/1999 Rahman
6,042,418 A 3/2000 Cummings
6,091,204 A 7/2000 Chen
6,116,563 A * 9/2000 Tsai ..... A47G 33/06 211/205
6,273,584 B1 8/2001 Wang et al.
6,302,562 B1 10/2001 Wu
6,457,839 B1 * 10/2002 Grandoit ..... A47G 33/06 362/122
6,652,927 B1 11/2003 Chen
6,777,891 B2 8/2004 Lys et al.
6,883,951 B2 4/2005 Wu
6,908,215 B2 6/2005 Wu
6,914,194 B2 7/2005 Fan
7,052,156 B2 5/2006 Primeau
7,088,904 B2 8/2006 Ryan, Jr.
7,152,998 B2 12/2006 Rahman
7,235,815 B2 6/2007 Wang
7,445,824 B2 11/2008 Leung et al.
7,481,555 B2 1/2009 Huang et al.
7,494,244 B1 2/2009 Van Diep et al.
7,554,266 B1 6/2009 Chen
D623,084 S 9/2010 Chen et al.
7,926,978 B2 4/2011 Tsai
8,371,716 B2 2/2013 Shen et al.
8,397,381 B2 3/2013 Tsai
8,454,186 B2 6/2013 Chen
8,454,187 B2 6/2013 Chen
8,469,750 B2 6/2013 Chen
8,562,175 B2 10/2013 Chen
8,568,015 B2 10/2013 Chen
8,569,960 B2 10/2013 Chen
8,592,845 B2 11/2013 Chen
8,608,342 B2 12/2013 Chen
8,622,576 B2 1/2014 Zhang
8,870,404 B1 * 10/2014 Chen ..... F21S 4/10 362/123
8,876,321 B2 11/2014 Chen
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung et al.
9,157,587 B2 10/2015 Chen
9,179,793 B2 11/2015 Chen
9,220,361 B1 12/2015 Chen
9,222,656 B2 12/2015 Chen
9,439,528 B2 9/2016 Chen
9,441,800 B1 9/2016 Chen
9,441,823 B1 9/2016 Chen
9,526,286 B2 12/2016 Chen
9,572,446 B2 2/2017 Chen
9,593,831 B2 3/2017 Yu
9,648,919 B2 5/2017 Chen
9,671,074 B2 6/2017 Chen
9,677,748 B1 6/2017 Chen
9,677,749 B2 6/2017 Chen
9,752,771 B2 9/2017 Loos
9,845,925 B2 12/2017 Chen
9,883,566 B1 1/2018 Chen
9,887,501 B2 2/2018 Chen
9,939,117 B1 4/2018 Peng
10,006,596 B2 6/2018 Yu et al.
10,178,887 B1 1/2019 Chen
10,184,654 B1 1/2019 Chen
10,205,073 B2 2/2019 Altamura
10,288,235 B1 5/2019 Chen
10,288,236 B1 5/2019 Chen
10,533,738 B2 1/2020 Leung et al.
10,578,260 B1 3/2020 Chen
10,624,166 B1 4/2020 Shao
10,697,598 B1 6/2020 Chen et al.
2002/0027778 A1 3/2002 Ko
2002/0097573 A1 * 7/2002 Shen ..... F21S 4/10 362/123
2003/0063463 A1 4/2003 Sloan et al.
2004/0012950 A1 * 1/2004 Pan ..... F21S 4/10 362/123
2004/0080281 A1 4/2004 Pan
2004/0090770 A1 * 5/2004 Primeau ..... F21S 4/10 362/123
2004/0096596 A1 5/2004 Palmer, III et al.
2004/0246718 A1 12/2004 Fan
2005/0018424 A1 1/2005 Popovich
2005/0047136 A1 3/2005 Fan
2005/0249892 A1 11/2005 Rocheleau
2006/0158878 A1 7/2006 Howell
2006/0164834 A1 * 7/2006 Kao ..... A47G 33/06 362/249.01
2006/0221609 A1 10/2006 Ryan, Jr.
2007/0015396 A1 1/2007 Mrakovich et al.
2007/0147028 A1 * 6/2007 Chan ..... A47G 33/06 362/123
2007/0195516 A1 * 8/2007 Cheng ..... F21S 4/10 362/123
2007/0230174 A1 * 10/2007 Hicks ..... F21S 13/14 362/249.16
2007/0262725 A1 11/2007 Koren
2008/0049424 A1 2/2008 Wang
2008/0084695 A1 4/2008 Hsu
2008/0094828 A1 4/2008 Shao
2008/0174995 A1 7/2008 Tong
2008/0218092 A1 9/2008 Chang et al.
2008/0291662 A1 * 11/2008 Barbieri ..... F21S 4/20 362/123
2009/0154156 A1 6/2009 Lo et al.
2009/0278463 A1 11/2009 Tang
2009/0302771 A1 12/2009 Peng
2010/0001664 A1 1/2010 Shih
2010/0157598 A1 * 6/2010 Tsai ..... F21V 21/002 362/249.01
2011/0062875 A1 3/2011 Altamura
2011/0074300 A1 3/2011 Hsu
2011/0215368 A1 9/2011 Chen
2011/0228535 A1 9/2011 Shao
2011/0286223 A1 11/2011 Chen
2011/0303939 A1 12/2011 Chen

(56) References Cited

U.S. PATENT DOCUMENTS

| | | | | |
|---|---|---|---|---|
| 2011/0305022 | A1 | 12/2011 | Chen | |
| 2011/0310601 | A1 | 12/2011 | Shao | |
| 2012/0039070 | A1 | 2/2012 | Shen et al. | |
| 2012/0075863 | A1 | 3/2012 | Chen | |
| 2012/0275157 | A1 | 11/2012 | Hsu | |
| 2013/0078847 | A1 | 3/2013 | Chen | |
| 2013/0249417 | A1 | 9/2013 | Verlinden | |
| 2013/0301245 | A1* | 11/2013 | Chen | A47G 33/06 362/123 |
| 2013/0301246 | A1 | 11/2013 | Chen | |
| 2014/0049168 | A1* | 2/2014 | Chen | F21S 4/10 315/161 |
| 2014/0087094 | A1 | 3/2014 | Leung et al. | |
| 2014/0268689 | A1* | 9/2014 | Chen | A47G 33/08 362/123 |
| 2014/0334134 | A1 | 11/2014 | Loomis | |
| 2015/0008835 | A1 | 1/2015 | Sugiura et al. | |
| 2015/0029703 | A1 | 1/2015 | Chen | |
| 2015/0070878 | A1* | 3/2015 | Yu | H05B 45/00 362/123 |
| 2015/0157159 | A1 | 6/2015 | Leung et al. | |
| 2016/0183338 | A1 | 6/2016 | Loomis et al. | |
| 2016/0186940 | A1 | 6/2016 | Del Castillo et al. | |
| 2016/0341408 | A1 | 11/2016 | Altamura | |
| 2017/0023223 | A1 | 1/2017 | Tsai | |
| 2017/0038055 | A1 | 2/2017 | Daniels | |
| 2017/0055319 | A1 | 2/2017 | Rogers | |
| 2017/0343170 | A1 | 11/2017 | Yu et al. | |
| 2018/0172225 | A1 | 6/2018 | Zhao | |
| 2018/0172226 | A1 | 6/2018 | Zhao | |
| 2018/0177026 | A1 | 6/2018 | Bowser et al. | |
| 2018/0231226 | A1 | 8/2018 | Koo et al. | |
| 2018/0299084 | A1 | 10/2018 | Chien | |
| 2019/0053348 | A1 | 2/2019 | Harris | |
| 2019/0078767 | A1 | 3/2019 | Loomis | |
| 2019/0277458 | A1 | 9/2019 | Shao | |
| 2019/0335559 | A1 | 10/2019 | Shao | |
| 2020/0236746 | A1 | 7/2020 | Shao | |

FOREIGN PATENT DOCUMENTS

| | | | |
|---|---|---|---|
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| DE | 3240446 | A1 | 7/1983 |
| DE | 8436328 | | 4/1985 |
| GB | 2 454 546 | A | 5/2009 |

* cited by examiner 360
362
278
402

360
362
278
407
424
404
400

360
362
278
407
424
402
400
300a
300

ARTIFICIAL TREE WITH LED-BASED LIGHTING SYSTEMS

RELATED APPLICATIONS

This application is a continuation of U.S. patent application Ser. No. 15/683,639, entitled "Artificial Tree With LED-Based Lighting Systems", filed Aug. 22, 2017, which claims the benefit of U.S. Provisional Patent Application No. 62/377,848 entitled "Artificial Tree With LED-Based Lighting Systems", filed Aug. 22, 2016, U.S. Provisional Patent Application No. 62/466,547 entitled "Refractive Decorative Lighting String", filed Mar. 3, 2017, and U.S. Provisional Patent Application No. 62/466,646 entitled "Shapeable Light String and Method for Decoration", filed Mar. 3, 2017, the disclosures of which are incorporated by reference herein in their entireties.

FIELD OF THE DISCLOSURE

The present disclosure relates to artificial trees. More specifically, the present disclosure relates to artificial trees with light-emitting-diode-based lighting and wiring systems, including LED-based lighting and wiring systems that include single-strand-conductor LED light strings.

BACKGROUND OF THE DISCLOSURE

Traditional lighted artificial trees typically include a tree stand, one or more trunk sections with attached branches, and multiple strings of lights. Branches are often attached at an end to branch holders on the trunk, allowing to the branches to pivot, such that in a display state, the branches are pivoted to a position away from the trunk, and in a storage state, are pivoted to a position toward the trunk. The pivoting of the branches allows the tree to be compressed to a smaller overall size for storage.

Traditional light strings typically include a set of insulated wires and incandescent bulbs. The insulated wires typically comprise a pair of insulated multi-strand conductors, for example, a pair of 22 AWG insulated wires, each multi-strand conductor having sixteen twisted copper strands, connected to each bulb. A thick layer of PVC insulation is formed around each of the multi-strand conductors. The light strings are generally draped across multiple branches of the tree, traversing branches that may be horizontally adjacent one another, i.e., side-by-side, and traversing branches that may be vertically adjacent one another, i.e., above and below one another.

FIG. 1 depicts one such traditional lighted artificial tree with pivoting branches and strings of lights draped diagonally across multiple branches.

More recently, and in an effort to increase energy efficiency and reliability, manufacturers have begun using light-emitting diodes (LEDs) rather than incandescent bulbs. Indeed, lighted artificial trees having light strings with LEDs rather than incandescent bulbs are well known. Such known lighted artificial trees often simply replace the incandescent bulbs with similar bulb or lamp assemblies that use LED "bulbs," utilizing the same insulated, multi-strand conductor wiring as the incandescent-bulb-based light strings, and utilizing the same techniques of draping the light strings across multiple branches. In some cases, the lower current requirements of the LEDs may allow the use of smaller diameter conductors or fewer conductor strands, for example, allowing the use of 25 AWG wire, for example, instead of 22 AWG wire.

While such a technique maintains the look and feel of a traditional tree having traditional light strings, with the growing popularity of more and more lights on a tree, such trees, even with LED technology, include an enormous length of insulated wire that remains visible on the branches of the tree, thereby diminishing the perceived attractiveness of the tree. Further, the draping of light strings across individually pivoting branches generally requires the use of relatively strong, traditional wires having conductor thicknesses that may be oversized given the low current draw of LEDs.

One known solution to the problem of unsightly wires is to locate wires connecting bulbs inside the branches themselves. For example, U.S. Pat. No. 3,970,834 to Smith discloses hollow branches with wires inside the branches. Other known trees, such as those described in German utility model patent DE 8436328.2 to Otto, disclose plastic plug-in branches with wires molded directly into the branches at an interior location. In yet a more modern example including LED lights, US Patent Publication No. 2015/0070878 to Yu also discloses branch wires molded or embedded into branches.

However, such solutions tend to be overly complicated, expensive to manufacture, and still do not take full advantage of the low-current requirements of LED lamps.

SUMMARY OF THE INVENTION

Embodiments of the invention include a multi-sectional artificial tree with a tree lighting system. The tree includes: a first tree section, including: a first tree frame section, comprising a first trunk portion, a first plurality of branch support portions connected to the first trunk portion, each of the first plurality of branch support portions including a first plurality of branch-receiving portions, a first plurality of branches connected to the first plurality of branch-receiving portions, each branch of the first plurality of branches including a branch shaft, the first plurality of branch-receiving portions of each of the first plurality of branch support portions defining a first predetermined number of branch-receiving portions; a first trunk electrical connector including a first plurality of conductive electrical terminals; a first tree section wiring portion of the tree lighting system in electrical connection with the first trunk electrical connector, the first tree section wiring portion comprising a first tree-section connector, a first plurality of wires connected to the first tree-section connector, and a first plurality of groups of light-set connectors connected to the first plurality of wires, each group of the first plurality of groups adjacent to one of the first plurality of branch support portions and having a first predetermined number of light-set connectors, the first plurality of groups of light-set connectors defining a first predetermined number of groups of light-set connectors, wherein the first predetermined number of groups of light-set connectors is the same number as the first predetermined number of branch support portions, and the first predetermined number of light-set connectors is the same number as the first predetermined number of branch-receiving portions; a plurality of groups of first tree section light sets, each group of the plurality of groups of first tree section light sets having a predetermined number of first tree section light sets, wherein the predetermined number of first tree section light sets is the same number as the first predetermined number of branch-receiving portions. The tree also includes a second tree section configured to couple to the first tree section, including: a second tree frame section, comprising a second trunk portion, a second plurality of branch support portions connected to the first trunk portion, each of the second plurality of branch support portions including a second plurality of branch-receiving portions, a second plurality of branches connected to the second plurality of branch-receiving portions, each branch of the second plurality of branches including a branch shaft, the second plurality of branch-receiving portions of each of the second plurality of branch support portions defining a second predetermined number of branch-receiving portions; a second trunk electrical connector including a second plurality of conductive electrical terminals, the second trunk electrical connector configured to connect to the first trunk electrical connector; a second tree section wiring portion of the tree lighting system in electrical connection with the second trunk electrical connector, the second tree section wiring portion comprising a second tree-section connector, a second plurality of wires connected to the second tree-section connector, and a second plurality of groups of light-set connectors connected to the first plurality of wires, each group of the second plurality of groups adjacent to one of the second plurality of branch support portions and having a second predetermined number of light-set connectors, the second plurality of groups of light-set connectors defining a second predetermined number of groups of light-set connectors, wherein the second predetermined number of groups of light-set connectors is the same number as the second predetermined number of branch support portions, and the second predetermined number of light-set connectors is the same number as the second predetermined number of branch-receiving portions; and a plurality of groups of second tree section light sets, each group of the plurality of groups of second tree section light sets having a predetermined number of second tree section light sets, wherein the predetermined number of first tree section light sets is the same number as the second predetermined number of branch-receiving portions.

Embodiments of the invention also include multi-sectional artificial tree with a tree lighting system, comprising: a power converter configured to receive in incoming alternating-current (AC) power from an external power source and to output a direct-current (DC) power, the power converter defining a DC output voltage; a first tree section, including: a first tree frame section, comprising a first trunk portion, a first branch support portion connected to the first trunk portion, and a first plurality of branches connected to the first branch support portion; a first trunk electrical connector including a first plurality of conductive electrical terminals, the first trunk electrical connector in electrical connection with the power converter; a first plurality of light sets attached to the first plurality of branches and configured to receive power from the power converter, each of the first plurality of light sets comprising a connector portion, a pair of continuous single-conductor wires connected to the connector portion, and a plurality of light-emitting diodes (LEDs), each of the plurality of LEDs electrically connected to the pair of continuous single-conductor wires and defining an operating voltage that is lower than the DC output voltage of the power converter and electrically connected in parallel to each other, wherein each light set of the first plurality of light sets is attached to only one of the first plurality of branches, such that the first tree section includes one light set per one branch, and each of the first plurality of light sets is electrically connected in series to the other. The tree also includes a second tree section, including: a second tree frame section, comprising a second trunk portion, a second branch support portion connected to the second trunk portion, and a second plurality of branches connected to the second branch support portion, wherein the second plurality of branches comprises fewer branches than the first plurality of branches; a second trunk electrical connector configured to connect to the first trunk electrical connector so as to transmit the DC power from the first tree section to the second tree section, the second trunk electrical connector including a second plurality of conductive electrical terminals; a second plurality of light sets attached to the first plurality of branches and configured to receive power from the power converter, each of the first plurality of light sets comprising a connector portion, a pair of continuous single-conductor wires connected to the connector portion, and a plurality of light-emitting diodes (LEDs), each of the plurality of LEDs electrically connected to the pair of continuous single-conductor wires and defining an operating voltage that is lower than the DC output voltage of the power converter and substantially equal to the operating voltage of the LEDs of the first plurality of light sets, the LEDs being electrically connected in parallel to each other, wherein each light set of the second plurality of light sets is attached to only one of the second plurality of branches, such that the second tree section includes one light set per one branch, and each of the second plurality of light sets is electrically connected in series to the other; and a resistor having a predetermined resistance value electrically connected in series with the second plurality of light sets, the predetermined resistance value determined based on the DC output of the power converter, the operating voltage of the second plurality of LEDs and a number of the light sets of the second plurality of light sets.

Embodiments of the invention also include methods of manufacturing multi-sectional artificial trees with tree lighting systems. One such embodiment includes a method of manufacturing a multi-section lighted tree that includes: assembling light sets with LEDs and connectors; assembling branches; assembling tree frame sections without branches; assembling light sets with LEDs and connector; assembling power subsystems, including a first, second and third trunk power subsystems and assembling branch-support-to-branch-support wiring subsystems; inserting power subsystems into respective tree frame sections, and connecting wiring subsystems to their respective power subsystems; assembling light sets onto branches; connecting branches with lights to branch support portions; and connecting connectors of light sets to wiring subsystems.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

DETAILED DESCRIPTION

Figure 2:
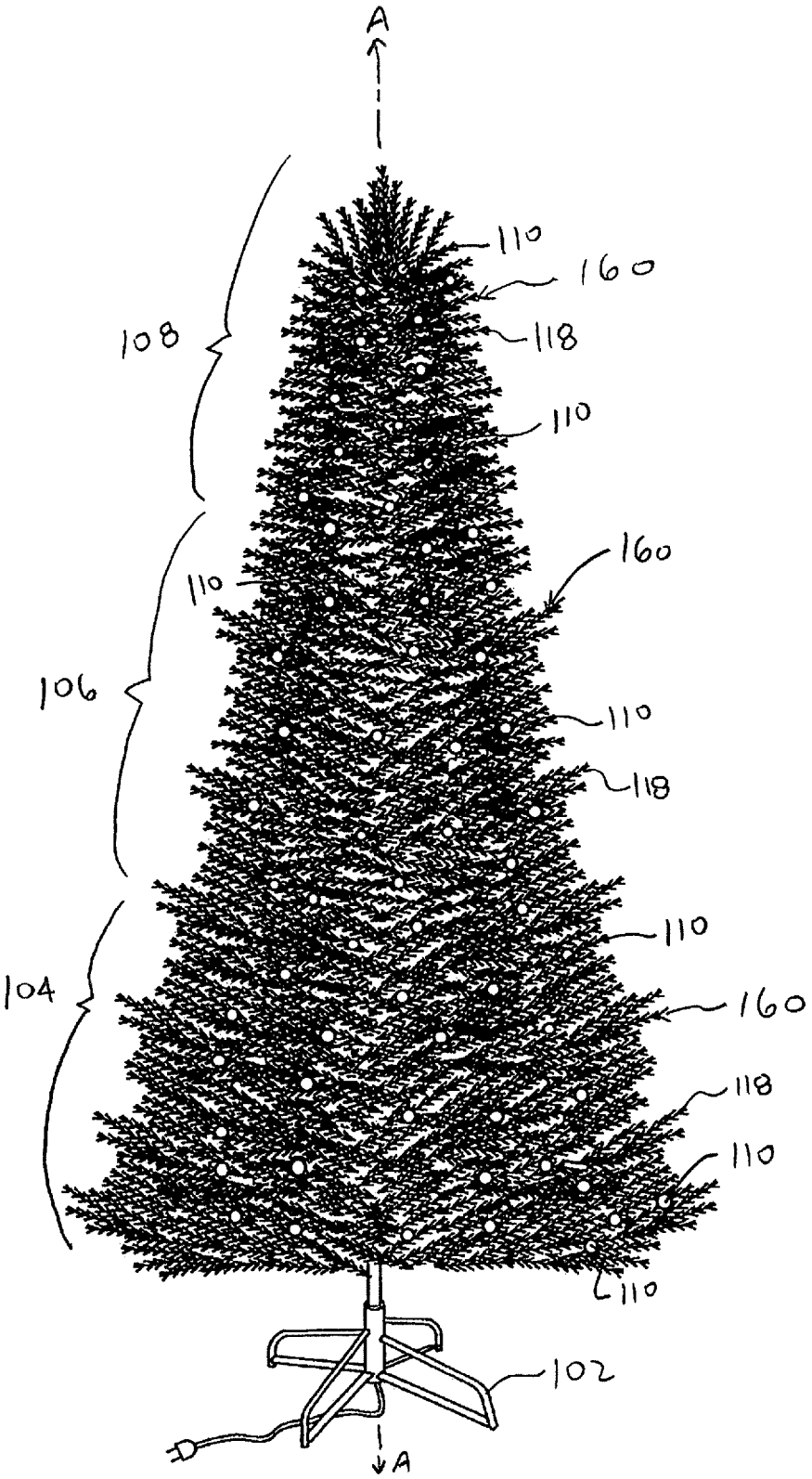
FIG. 2 is a front, perspective view of an artificial tree with a tree-lighting system, according to an embodiment.

Referring to FIG. 2, an embodiment of a lighted artificial tree 100 with a light-emitting-diode-based lighting system is depicted. In the depicted embodiment, tree 100 includes tree stand 102 and three tree sections, first tree section 104, second tree section 106 and third tree section 108. As depicted, tree section 104 fits into tree stand 102, tree section 106 couples to tree section 104, and tree section 108 couples to tree section 106 along central vertical axis A. It will be understood that tree 100 may include more or fewer than three tree sections. In some embodiments, tree 100 includes a single tree section; in other embodiments, two tree sections or four tree sections, or in some embodiments, more than four tree sections. Generally, a relatively tall tree will include more tree sections as compared to a relatively short tree section. Each tree section includes a plurality of light-emitting-diodes (LEDs) 110, as will be described further below.

Figure 1:
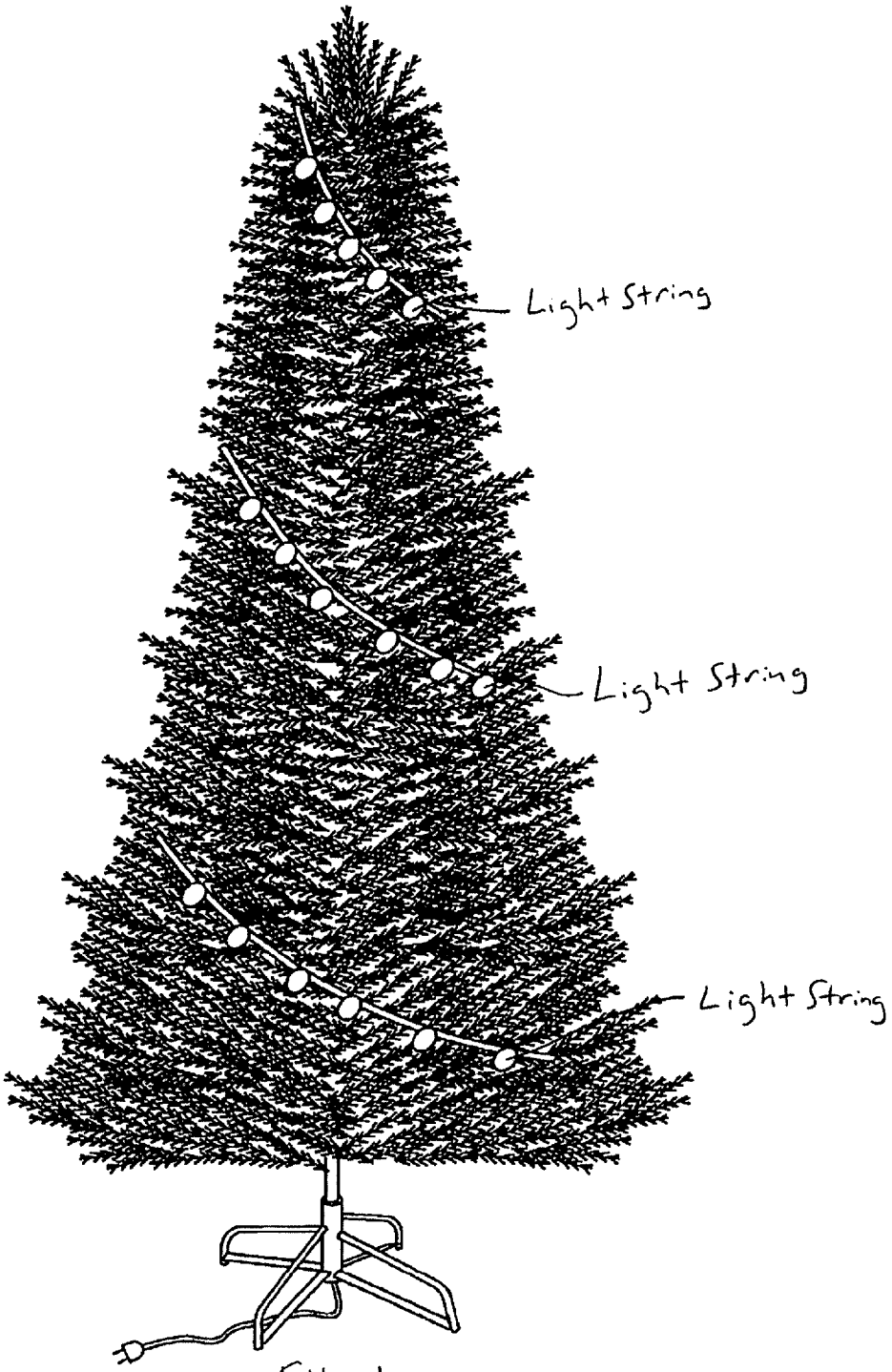
FIG. 1 (Prior Art)
FIG. 1 depicts a prior art artificial tree with traditional light strings.
Figure 4:
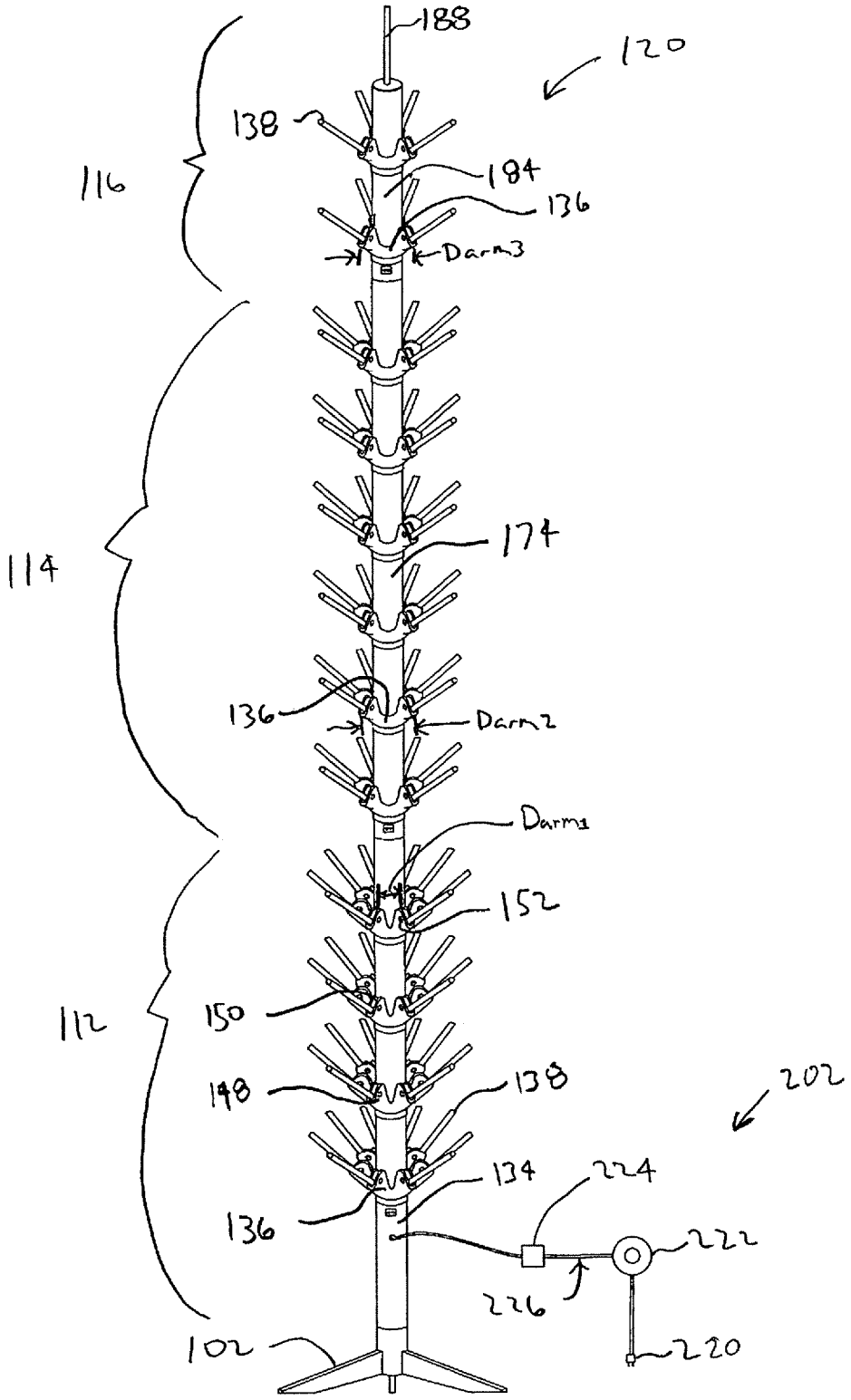
FIG. 4 is the tree frame of FIG. 3 with individual tree frame sections depicted as assembled together.
Figure 5:
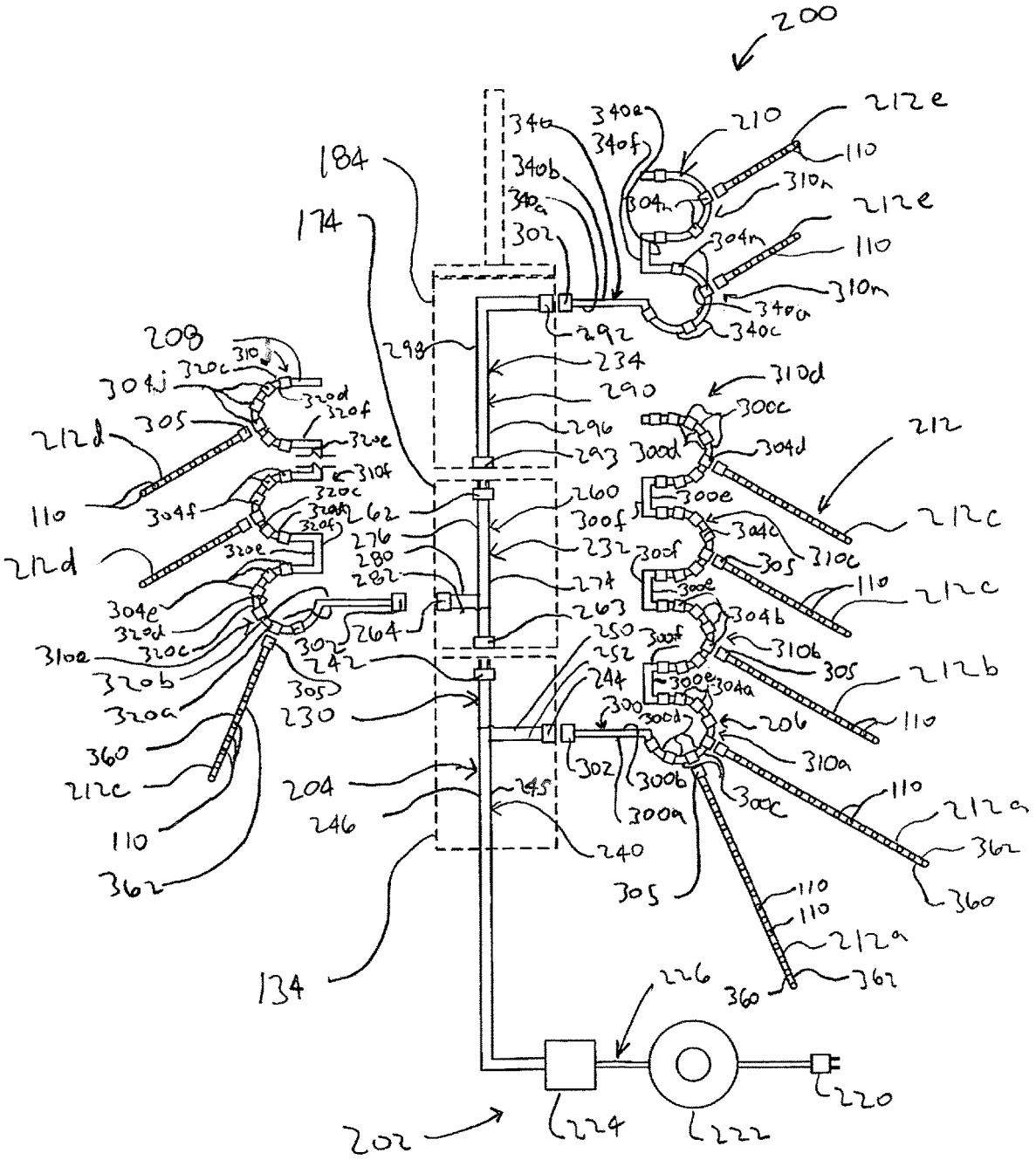
FIG. 5 is a block diagram of a tree lighting system, according to an embodiment.

In an embodiment, each tree section, including tree sections 104, 106, and 108, includes a tree frame section 112, 114, and 116, respectively (FIGS. 3-4), a plurality of branches 160 and a plurality of artificial leaves or needles 118 (FIG. 1), and an LED-based lighting subsystem (FIG. 5).

Figure 3:
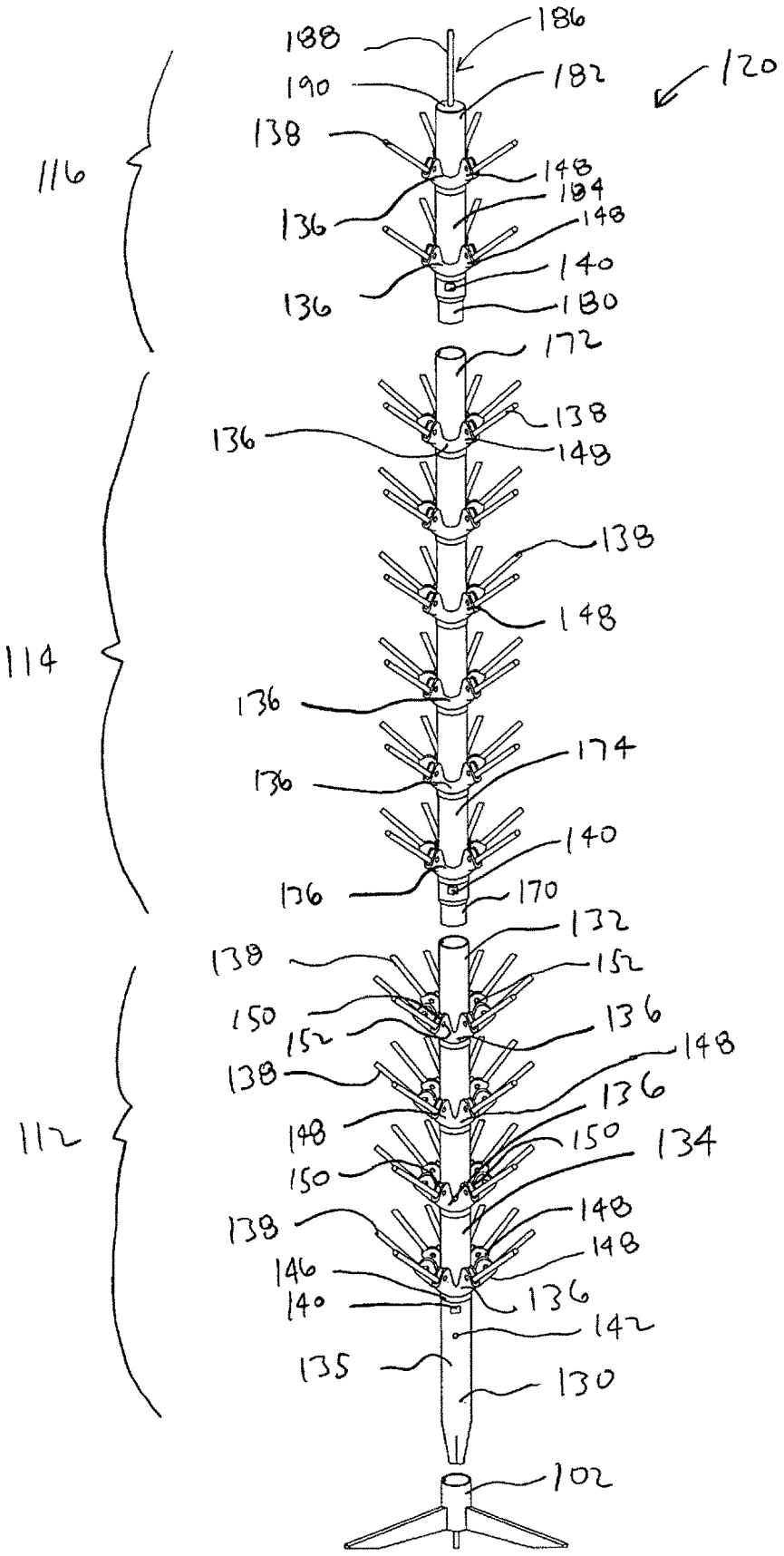
FIG. 3 is a front, perspective, partially-exploded view of a tree frame of an artificial tree, according to an embodiment.

Referring to FIGS. 3 and 4, a partially exploded view of tree frame 120 is depicted (FIG. 3), and an assembled view of tree frame 120 is depicted (FIG. 4). Tree frame 120 comprises first tree frame section 112, second tree frame section 114 and third tree frame section 116.

First tree frame section 112 includes first end 130, second end 132, first trunk portion 134, a plurality of branch support portions 136, and a plurality of branch portions 138. First tree frame section 112 may comprise a bottom section of tree frame 120, First trunk portion 134, in an embodiment, and as depicted, comprises a hollow, cylindrical structure defined by trunk wall 135. In an embodiment, trunk portion 134 comprises a metal material, though other materials may be utilized, including plastic. First end 130 may be narrower than other portions of trunk portion 134 and be configured to be inserted into tree stand 102. Second end 132 defines an open end configured to receive an end of second tree frame section 114. In an embodiment, trunk portion 134 defines one or more trunk apertures 140 for receiving a portion of a lighting subsystem. First trunk portion 134 may also define trunk power-cord aperture 142 for receiving a power cord.

Each branch support portion 136 includes base portion 146 and a plurality of branch support arms or branch-receiving portions 148, each branch support arm defining a branch-portion receiving slot 150 and a pin aperture 152. Branch support arms 148 are attached to, or integrated into, base portion 146. Branch support arms 148 are distributed about an exterior of base portion 146 and extend outwardly and away from base portion 146. In an embodiment, each branch support arm 148 on a particular branch support portion 136 are distributed equidistantly by a distance $D_{arm}$ ($D_{arm1}$, $D_{arm2}$, and $D_{arm3}$ for respective tree frame sections 112, 114, and 116—see FIG. 4). In an embodiment, the distance $D_{arm}$ between branch support arms 148 of branch support portions 136 on one tree section varies as compared to the distance between branch support arms 148 of another tree section. In an embodiment, the distance $D_{arm}$ increases from lower tree frame sections to upper tree sections, or from a bottom of assembled tree 100 to a top of assembled tree 100. In an embodiment, $D_{arm1}$ is less than $D_{arm2}$, and $D_{arm2}$ is less than $D_{arm3}$. In such an embodiment, the resulting increasing distance between branch support arms 148 is the result of fewer branch support arms 148 on branch support portions 136 on upper tree sections as compared to lower tree sections, while trunk diameters 134, 174 and 184, as well as base portion 146 diameters remain relatively the same from section to section.

Each base portion 146 is affixed to first trunk portion 134, and distributed vertically along a length of first trunk portion 134. In an embodiment, branch support portions 136 comprise a metal material and are welded to trunk portion 134 to affix them to the trunk.

In an embodiment, and as depicted, first tree frame section 112 includes four branch support portions 136, each branch support portion including eight branch-support arms 148. First tree frame section 112 may include more or fewer than four branch support portions 136, depending on first trunk portion 134 length (a longer length generally having more portions 136), and depending on desired branch density (more portions 136 generally meaning higher branch density). Each branch support portion 136 may have more or fewer than eight branch support arms 148. A relatively higher number of branch support arms 148 not only increases branch density (number of branches at one vertical level), but also facilitates the use of more and longer branches on a lower tree section, i.e., tree section 104. If tree 100 is intended to resemble a pine tree, as most artificial Christmas trees do, then branch portions 138 and branches 160 will be longer, and greater in quantity, near the bottom tree section, or first tree section 104 to give tree 102 a more full and natural appearance. Consequently, and as described further below, branch support portions 136 of tree sections 106 and 108 (and tree frame sections 114 and 116) may include fewer branch arms 148 per branch support portion 136, as compared to tree section 104.

Branch portions 138 may generally comprise a linear rod as depicted, and may comprise a metal material. However, in other embodiments, branch portions 138 may comprise other shapes and materials as desired to resemble a branch of a real tree. An attached end of each branch portion 138 is received by a receiving slot 150 such that each branch portion 138 is supported by a branch support arm 148. As will be understood by those of skill in the art, the attached end of a branch portion 138 may comprise a circular shape, or otherwise define an aperture. A pin, or other fastener, not show, may be inserted through such an aperture, and through the apertures 152 of branch support arms 148 to secure the branch portion 138 to the branch support arm in a manner that allows pivoting of the branch portion 138 with respect to the fixed branch support arm.

Referring specifically to FIG. 2, a plurality of artificial leaves or needles or sub-branches 118 may be attached to branch portions 138 to form completely assembled branches 160.

Referring again to FIGS. 2 and 3, although branch portions 138 are depicted as having approximately the same length, it will be understood that branch portions 138 and branches 160 may vary in length within a single tree section or tree frame section. For example, branch portions 138 and branches 160 on tree section 104 and tree frame section 113 may be longest at the bottom (near end 130), and shortest at the top (near end 132). The same may be true of branch portions 138 and branches 160 of the second and third tree sections 106, 108 and second and third tree sections 114, 116. In an embodiment, branch portions 138 and branches 160 on a particular branch support portion 136 may all have substantially the same length, thereby providing a generally uniform circumferential outline to tree 100 at any particular height.

Further, branch portions 138 and branches 160 may gradually be shorter in length (distance projecting from a respective trunk portion), from tree 100 bottom to top. This includes branch portions and branches being shorter in second tree section 106 as compared to branch portions and branches of first tree section 104, and longer as compared to branch portions and branches of third tree section 108.

Second tree frame section 114 is substantially similar to tree frame section 112, and includes first end 170, second end 172, trunk portion 174, a plurality of branch support portions 136 and a plurality of branch portions 138. Second tree frame section 114 may comprise a middle section of tree frame 120, First end 170 may be tapered, or have a smaller diameter as compared to other portions of trunk portion 174, and is configured to insert into second end 132 of first tree frame section 112. In other embodiments, first and second tree frame sections 112 and 114 may be coupled by other means, such as a sleeve structure. As depicted, trunk portion 174 may be coupled to trunk portion 134 in any rotational alignment as no keying structure is provided. In other embodiments, keying structure may be provided at trunk portion ends such that the trunk portions must be rotationally aligned to a single rotational alignment, or one of multiple rotational alignments, relative to one another so as to be joined.

Second tree frame section 114 is depicted as having a longer trunk portion 174 as compared to trunk portion 134, and therefore includes more branch support portions 136; in this embodiment, second tree frame section 114 includes six branch support portions 136. However, the number of branch support portions 136 may be greater or fewer than six. Trunk portion 174 may have a length that is substantially the same as, or less than trunk portion 134, depending on many factors, including ease of manufacturing, desired tree section weight, packaging, and so on. As with the other tree frame sections, branch support portions 136 may be evenly distributed along the length of the trunk portion. In other embodiments, second trunk portion 174 may be longer or shorter than depicted.

Further, branch support portions 136, as described above, may include fewer branch support arms 148 as compared to branch support portions 136 of first tree frame section 112. As depicted, branch support portions 136 of second tree frame section 114 each include six branch support arms 148 (and hence six branch supports 148 and branches 160). In other embodiments, branch support portions 136 of second tree frame section 114 may include the same number of branch support arms as first tree frame section 112.

Third tree frame section 116, which corresponds to third tree section 108, and which may comprise a top section of tree frame 120, includes trunk portion 184 with first end 180 and second end 182, and a plurality of branch support portions 136 with a plurality of branch support arms 148 supporting multiple branch portions 138. Third tree frame section 116 may also include trunk extension portion 186 having extension 188 and connector 190.

Branch support portions 136 of third tree frame section 116 may comprise fewer branch support arms 148 as compared to branch support portions 136 of second and/or first tree frame sections 114 and 112. In an embodiment, branch support portions 136 of third tree frame section 116 may comprise four branch support arms 148 and fours branch portions 138, each. In other embodiments, branch support portions 136 include more or fewer branch support arms 148.

In embodiments including trunk extension 186, connector 190 is connected to third trunk portion 184. Connector 190 may be inserted fully or partially into an open end of third trunk portion 184. In an embodiment, connector 190 includes a portion fitting into third trunk portion 184, and a portion remaining outside portion 184. In one such embodiment, the portion remaining outside may have a diameter that is larger than the diameter inside portion 184. In an alternate embodiment, connector 190 may fit over end 182 of trunk portion 184.

Extension 188 may comprise a rod or mast or more generally, a substantially straight or linear projecting structure affixed to connector 190. In an embodiment, artificial leaves or needles 118 are affixed directly to extension 188 to form the very top of tree 100.

As described above, tree frame 120 may comprise a variety of structural configurations, with variations on trunk portion length, number of branch support portions 136, number of branch portions 138 per branch support portion 136, branch portion length, and so on.

In an embodiment of tree frame 120, first trunk portion 134 has a length that is shorter than a length of second trunk portion 174, but longer than a length of third trunk portion 184, and in some cases, longer than a combined length of third trunk portion 184 with extension 188. In one such embodiment, the number of branch support portions 136 of second tree frame section 114 may be greater than a number of branch support portions 136 of first tree frame portion 112, and greater than a number of branch support portions 136 of third tree frame portion 116. In one such embodiment, the number of branch support arms 148 per branch support portion 136 is greater on some branch support portions 136 of first tree frame section 112 as compared to second tree frame section 112; and the number of branch support arms 148 per branch support portion 136 is greater on some branch support portions 136 of second tree frame section 114 as compared to third tree frame section 116, such that the number of branches at a given tree 100 height or branch support portion 136 decreases from a bottom of tree 100 to a top of tree 100, when assembled. Further, the number of branch support arms 148 per branch support portion 136 is greater on some branch support portions 136 near end 130 of first tree frame section 112 as compared to branch support portions 136 near end 132 (not depicted). The same feature may be present in each of second tree frame section 114 and third tree frame section 114.

The feature of decreasing branch 160 and branch portion 138 lengths from tree or section bottom to top may also be present in combination with any of the features and embodiments as described above.

Referring also to FIG. 4, an assembled tree frame 120 is depicted. As described above with respect to FIG. 3, first tree frame 112 is configured to be inserted into tree stand 102; second tree frame 114 is configured to be inserted into first tree frame 112, and third tree frame 116 is configured to be inserted into second tree frame 114, to form an assembled tree frame 120.

Also depicted in FIG. 4 is an input portion 202 of tree lighting system 200, including power plug 220, optional switch 222, and optional controller 224.

Referring to FIG. 5, a block diagram of an embodiment of tree lighting system 200 is depicted. Tree lighting system 200 includes input power portion 202, trunk power portion 204, tree section wiring portions 206, 208, and 210, and light sets 212. For the sake of illustration, trunk portions 134, 174 and 184 of respective tree sections 104, 106 and 108 are depicted in dashed lines to suggest the relative placement of portions of tree lighting system 200. Also for the sake of illustration, tree section wiring portions 206, 208 and 210, as well as light sets 212 are depicted in a disconnected state, though it will be understood that the various components and portions of system 200 will be mechanically and electrically connected to one another when assembled onto tree 100, as described further below.

Generally, tree lighting system 200 transmits electrical power from an external power source to light sets 212 and lights 110, distributed about branches 160 of tree 100. Transmission of power to light sets 212 may be selective in that power to light sets 212 or lights 110 is selectively turned on and off, including for basic on/off functions as well as more sophisticated control functions, such as twinkling, color-changing, flashing, and so on. Tree lighting system 200 may also transmit communication signals to portions of tree 100, including to light sets 212. Lights 110 may generally comprise LEDs, but in some embodiments, may comprise incandescent lamps. LEDs 110 may comprise an assembly with an LED chip having a diode. In some embodiments, LEDs 110 may comprise multiple LEDs, such as a red-green-blue (RGB) LED chip. In some embodiments, a light 110 may comprise an integrated controller (IC) chip for control of one or more LEDs of a light 110. In some assemblies, one or more LEDs may comprise a "twinkling" LED, wherein an LED 110 assembly includes electronics causing the LED to periodically turn on and off. In an embodiment, a light set 212 includes all non-twinkling LEDs; in another embodiment, a light set 212 includes one or more twinkling LEDs, and in one such embodiment, tree 100 includes twinkling LEDs that comprise less than 10% or less than 5% twinkling LEDs, depending on the desired effect. Twinkling LEDs may be employed without a central control device.

As described further below, tree lighting system 200 utilizes internal and external wiring subsystems, connectors, and light sets with mechanical features that correspond to mechanical features of tree frame 120 of tree 100, and takes advantage of low-current characteristics of LEDs in a safe and efficient manner.

As depicted, input power portion 202 includes power plug 220, optional switch 222, optional controller 224 and input power wiring 226. Power plug 220 is configured to be connected to an external source of power, which may comprise a 120V alternating-current (AC) power source. Optional switch 222 may comprise a switch configured to selectively allow power and/or communication signals to be transmitted through tree lighting system 200. Optional controller 224 may comprise a controller, microprocessor or other control device for controlling power and/or communication signals. In an embodiment, switch 222 and controller 224 may be combined. In another embodiment, tree lighting system 200 may also include power-conditioning circuitry, such as an electrical transformer or other such known electrical componentry for lowering or converting input voltage. In an embodiment, such power-conditioning circuitry includes an AC-DC (direct current) circuit, which may include a transformer. In another embodiment, such power-conditioning circuitry includes and AC-AC circuit for lowering incoming AC voltage to a voltage appropriate for the electronics, including light sets 212 of lighted artificial tree 100. In an embodiment, such power-conditioning circuitry may be integrated into power plug 220, or may be included with switch 222 and/or controller 224, or may be located elsewhere on, in or about tree 100.

Input wiring 226 comprises at least two insulated conductors. Each conductor may comprises a plurality of conductor strands, as is known and understood by those of ordinary skill. Herein, "conductor" is mean to include conductors that may comprise a plurality of conductor strands, or a single conductor strand, unless specifically indicated to the contrary. Input wiring 226 may include any or all wiring connecting power plug 220 to tree 120, including wires external to tree 100. In an embodiment, input wiring 226 forms a portion of first tree lighting subsystem, including in an embodiment where switch 222 and controller 224 are not present, or are not located external to tree 100.

Trunk power portion 204 of tree lighting system 200 includes the several trunk power subsystems particular to each tree and tree frame section. More specifically, trunk power portion 204 includes first trunk power subsystem 230, second trunk power subsystem 232 and third trunk power subsystem 234.

First trunk power subsystem 230 includes wires 240, first trunk electrical connector 242 and lighting connector 244. In an embodiment, first trunk power subsystem 230 includes only a single lighting connector 244. However, in other embodiments, subsystem 230 may include two or more lighting connectors 244 distributed about trunk portion 134, e.g., distributed around the trunk circumference at a common "height" and/or distributed vertically along the length of trunk portion 134.

Wires 240, in an embodiment, comprise insulated conductors, and are electrically connected to power plug 220, first trunk electrical connector 242 and lighting connector 244. Wires 240 include a plurality of individual wires, including, in an embodiment, wires 246, 248, 250 and 252. As depicted, and in an embodiment, wires 246 and 248 are electrically connected to power plug 220, first trunk electrical connector 242 and lighting connector 244. In the embodiment, depicted, a portion of each of wires 246 and 248 is located external to trunk portion 134 and a portion located internal to trunk portion 134. Wires 246 and 248 enter trunk portion 134 through trunk aperture 140 (see also FIG. 3). It will be understood that wires 246 and 248 may each be comprised of several wires or wire segments, rather than each comprising one long, single wire. For example, the portions of wires 246 and 248 outside of trunk 134 may comprise a pair of wire segments connected by a connector at the trunk wall (not depicted) to another pair of wire segments inside trunk 134.

Wires 250 and 252 electrically connect wires 246 and 248 to lighting connector 244. Wires 250 and 252 may make a mechanical connection to wires 246 and 248 at trunk electrical connector 242, in an embodiment, or at another connection point, as depicted.

In other embodiments, wires 240 comprise other mechanical configurations, such as a pair of wires 246, 248 entering trunk 134 then directly mechanically and electrically connecting to lighting connector 244, and a pair of wires 250 and 252 connected to trunk connector 242 lighting connector 244 (and also electrically connecting to wires 246, 248).

Trunk electrical connector 242 may be located wholly or partially within an interior of trunk portion 134. Trunk electrical connector 242 is in electrical connection with wires 240, and are configured to connect to a corresponding trunk electrical connector of second tree section 106, thereby transmitting electrical power and in some embodiments, communication data or signals, from tree section 104 to tree section 106, and from tree frame section 112 to tree frame 114. Trunk electrical connector 242, in an embodiment, includes a plurality, for example, two, three or four, electrical terminals connected to wires 240, and configured to connect to corresponding electrical terminals of a trunk electrical connector of tree section 106.

Embodiments of first trunk electrical connector 242, and other trunk electrical connectors described herein, are disclosed in U.S. Pat. No. 8,454,186 to Chen, entitled "Modular Lighted Tree with Trunk Electrical Connectors", US Patent Pub. No. 2013/0308301 to Chen, entitled "Modular Tree with Locking Trunk and Locking Electrical Connectors", U.S. Pat. No. 9,044,056 to Chen, entitled "Modular Tree with Electrical Connector", U.S. Pat. No. 9,179,793 to Chen, entitled "Modular Tree with Rotation-Lock Electrical Connectors", US Patent Pub. No. 2014/0287618, entitled Modular Tree with Locking Trunk and Locking Electrical Connectors", US Pat. Pub. No. US 2014/0268689 to Chen, entitled "Modular Tree with Trunk Connectors", all of which are incorporated herein by reference in their entireties.

Lighting connector 244, in an embodiment, is electrically connected to wires 250 and 252. In an embodiment, lighting connector 244 includes a pair of electrical terminals, such as electrical terminals, and is configured to mechanically and electrically connect to a connector of first tree section wiring portion 206. Lighting connector 244, in an embodiment, is received by trunk aperture 140 and is affixed to trunk wall 135 of trunk portion 134. In other embodiments, trunk connector 244 is located within an interior of trunk portion 134, or is located outside of trunk portion 134.

Second trunk power subsystem 232 is substantially similar to first trunk power subsystem 230, though without input portion 202, and with an additional trunk electrical connector. In an embodiment, second trunk power subsystem 232, first trunk electrical connector 262, second trunk electrical connector 263 and lighting connector 264. In an embodiment, first trunk electrical connector 262 is substantially the same as first trunk electrical connector 242. Second trunk electrical connector 263 includes a body portion and at least two electrical terminals, and is configured to mechanically and electrically connect to first trunk electrical connector 242 of first tree section 100. When trunk electrical connectors 242 and 263 are connected, tree sections 112 and 114 are electrically connected, such that power, and in some embodiments, communication data, flow between first tree section 112 to second tree section 114.

In an embodiment, lighting connector 264 is substantially the same as lighting connector 244. In an embodiment, second trunk power subsystem 232 includes only a single lighting connector 244. However, in other embodiments, subsystem 232 may include two or more lighting connectors 264 distributed about trunk portion 174, e.g., distributed around the trunk circumference at a common "height" and/or distributed vertically along the length of trunk portion 174.

Wires 260, in an embodiment, comprise insulated conductors, and are electrically connected to first trunk electrical connector 262, second trunk electrical connector 263 and lighting connector 264. Wires 260 include a plurality of individual wires, including, in an embodiment, wires 276, 278, 280 and 282. As depicted, wires 276 and 278 are electrically connected to first trunk electrical connector 262, second trunk electrical connector 263 and lighting connector 264. In the embodiment depicted, all portions of wires 260 are located within an interior of trunk portion 174. In other embodiments, portions of wires 260 may be located outside trunk portion 174, such as, but not limited to, portions of wires 280 and 282 extending through a trunk wall of trunk portion 174. It will be understood that wires 246 and 248 may each be comprised of several wires or wire segments, rather than each comprising one long, single wire.

Wires 280 and 282 electrically connect wires 276 and 278 to lighting connector 264. Wires 280 and 282 may make a mechanical connection to wires 276 and 278 at trunk electrical connector 262, in an embodiment, or at another connection point, as depicted.

In other embodiments, wires 260 comprise other mechanical configurations, such as a pair of wires 276, 288 directly mechanically and electrically connecting to lighting connector 264, and a pair of wires 280 and 282 connected to trunk connector 262 and lighting connector 264 (and also electrically connecting to wires 246, 248).

Trunk electrical connectors 262 and 263 may be located wholly or partially within an interior of trunk portion 174. Second trunk electrical connector 263 is in electrical connection with wires 260, and is configured to connect to a corresponding trunk electrical connector of third tree section 108, thereby transmitting electrical power and in some embodiments, communication data or signals, from second tree section 106 to third tree section 108, and from tree frame section 114 to tree frame section 116.

Lighting connector 264, in an embodiment, is electrically connected to wires 280 and 282 or other wires of wires 260. In an embodiment, lighting connector 264 includes a pair of electrical terminals, and is configured to mechanically and electrically connect to a connector of second tree section wiring portion 208. Lighting connector 264, in an embodiment, is received by a trunk aperture 140 of trunk portion 174, and is affixed to a trunk wall of trunk portion 174. In other embodiments, trunk connector 264 is located within an interior of trunk portion 174, or is located outside of trunk portion 174.

Third trunk power subsystem 234, in an embodiment, includes wires 290, first trunk electrical connector 292, second trunk electrical connector 293, and lighting connector 294. In an embodiment, wires 290, insulated conductors, include wires 296 and 298. In an embodiment, first trunk electrical connector 292 is substantially the same as first trunk connectors 262 and 242, and second trunk electrical connector 293 is substantially the same as second trunk connector 263.

In the embodiment depicted, third trunk power subsystem 234 is wholly within trunk portion 184, though in other embodiments, third trunk power subsystem 234, or a portion thereof, may be located outside of trunk portion 184, for example on an exterior of trunk portion 184.

Although depicted as being located primarily within their respective trunk portions, it will be understood that first, second and third trunk power subsystems 230, 232 and 234 may be located or positioned outside of their respective trunk portions. In one such embodiment, each power subsystem is attached to its respective trunk portion or branches of its respective tree section.

Tree lighting system 200 also includes tree section wiring portions 206, 208 and 210. In an embodiment, tree lighting system 200 includes one tree section wiring portion for each tree section, such that in the depicted embodiment having three tree sections and three tree frame sections, system 200 includes three tree section wiring portions. Generally, each tree section wiring portion makes a mechanical and electrical connection to its respective trunk power subsystem, and is distributed about its respective tree frame section. In the embodiment depicted, and as described further below, first tree section wiring portion 206 connects to first trunk power subsystem 230, second tree section wiring portion 208 connects to second trunk power subsystem 232, and third tree section wiring portion 210 connects to first trunk power subsystem 234.

An embodiment wherein each tree section includes a single tree section wiring portion, i.e., one assembled tree section wiring portion per tree section facilitates efficient manufacturing and assembly of the lighted tree 100. A tree section wiring portion can be manufactured to fit a particular tree section design, and easily assembled onto its respective tree frame section with a single point of electrical connection, and causing lights to be distributed uniformly about the tree, as is explained further below.

In an embodiment, first tree section wiring portion 206 includes first tree-section connector 302, a plurality of wires 300, and a plurality of light-set connectors 304 (304*a*, 304*b*, 304*c*, 304*d*).

Connector 302 is configured to mechanically and electrically connect to lighting connector 244, thereby connecting first tree section wiring portion 206 to first trunk power subsystem 230. Connector 302 may include a body portion and a plurality of electrical terminals, such as two terminals, or more than two terminals.

Wires 300 include the plurality of wires, comprising insulated conductors, of first tree section wiring portion 206, including the pair of wires 300*a* and 300*b* connected to connector 302, and the plurality of intermediate wires 300*c* and 300*d* connecting pairs of light-set connectors 304. Certain pairs of intermediate wires 300*c* and 300*d* comprise a pair of group joining wires that join groups of light-set connectors, as will be explained further below. Group joining wires, in an embodiment, are longer than other intermediate wires 300*c* and 300*d* as group joining wires extend vertically along trunk portion 134 from the vicinity of a lower branch support portion 136 to a relatively higher branch support portion 136. In the embodiment depicted, wires 300 include three pairs of group joining wires, wires 300*e* and 300*f*.

In the embodiment depicted, first tree section wiring portion 206 is wired in a parallel configuration to provide the same electrical voltage at each light-set connector 304, whether AC or DC. In other embodiments, not depicted in FIG. 5, first tree section wiring portion 206 may have a series or series-parallel connection, and hence have a different wiring connection configurations, such that one or more light-set connectors 304 are connected in a series configuration.

In the parallel configuration depicted, wires 300*a*, 300*c* and 300*e* conduct electricity at a first voltage polarity, which may be, e.g., a positive DC voltage or "live" AC voltage, and wires 300*b*, 300*d*, and 300*f* conduct electricity at a second voltage polarity, which may be, e.g., a negative DC voltage, or a "neutral" AC voltage.

Light-set connectors 304, which includes light-set connectors 304*a*-304*d*, are configured to receive wires 300 and connect to light sets 212. In the parallel embodiment depicted, and with the exception of the last light-set connector 304, each light-set connector 304 receives four wires. For example, a light-set connector 304 may receive two intermediate wires 300*c* and two intermediate wires 300*d*; a "first" light-set connector closest to connector 302, receives wires 300*a*, 300*b* and intermediate wires 300*c* and 300*d*. Embodiments of light-set connectors 304 and received wires are described in further detail below.

First tree section wiring portion 206 may be defined by distinct groupings of wires 300 and light-set connectors, forming connector groups 310, each connector group 310 serving a group of branches 160 of a particular and common branch support portion 136 (see, also, FIGS. 3 and 4), at a particular trunk location or tree height. In an embodiment, the number of groups 310 corresponds to the number of branch support portions 136, i.e., one group 310 for one branch support portion 136. Groups 310 are electrically connect to each other by group joining wires 300*e* and 300*f*.

In the embodiment depicted, first tree section wiring portion 206 includes four groups 310, namely, group 310*a*, 310*b*, 310*c*, and 310*d*, corresponding the four branch support portions 136 of first tree frame section 112 (and first tree section 104). Group 310*a* includes a plurality of intermediate wires 300*b* and 300*c*, and a plurality (e.g., eight, one for each branch support arm 148) of light-set connectors 304*a*. Groups 310*b*, 310*c* and 310 *d* include their respective intermediate wires 300*b* and 300*c*, and respective light-set connectors 304*b*, 304*c*, and 304*d*.

In an embodiment, intermediate wires 300*c* and 300*d* between light-set connectors 304 of a connector group 310 define a length sufficient to allow positioning of each individual light-set connector 304 of a group adjacent or near a branch support arm 148 of a branch support portion 136. Consequently, groups 310 are depicted in a ring-like formation as they are intended to be wrapped around trunk portion 134 such that each connector 304 is positioned near a branch support arm 148.

In an embodiment, a length of intermediate wire 304*b* or 304*c* may be substantially equal to one another; in one such embodiment, the length may be substantially equal to a distance $D_{arm1}$ (see, also, FIG. 4) between two adjacent branch support arms 148; in other embodiments, a length of intermediate wire 304*b* or 304*c* may be in a range of +/−10% of the distance $D_{arm1}$ between two adjacent branch support arms; in other embodiments, a length of intermediate wire 304*b* or 304*c* may be in a range of +/−25% of the distance $D_{arm1}$ between two adjacent branch support arms; other ranges may also be used. In other embodiments, the length of only some, rather than all, intermediate wires may be the same.

As described further below, when attached to first tree frame section 112 (directly or indirectly), intermediate wires 300*c* and 300*d* extend in a direction transverse to, or perpendicular to, the vertical axis A defined by tree 100 and its respective trunk portions. This direction will generally be referred to herein as "horizontal". Intermediate wires 300*c* and 300*d* extend generally horizontally in order to extend between branch support arms 148 of a branch support portion 136.

Conversely, and as depicted symbolically in FIG. 5, group joining wires 300*e* and 300*f* extend generally vertically, or generally parallel to vertical axis A of tree 100, or generally transverse to intermediate wires 300*c* and 300*d*. This vertical extension of wires joins one group to another group, for example, connector group 310*a* positioned at a branch support portion 136 to connector group 310*b* at another branch support portion 136.

The number of light-set connectors in each group 310 may be the same, or may vary along a height of tree frame section 112. In an embodiment, and as depicted, all groups 310 of first tree frame section 112 all have the same number of light-set connectors 304 (which, in an embodiment means that each trunk support portion 136 includes the same number of branch support arms, such as eight each).

In another embodiment, the number of light-set connectors 304 (and hence light sets 212) may be greatest at the group 310 positioned at the lowermost portion of first tree frame section 112, which in an embodiment, may be the group closest to connector 302, or group 310*a* with light-set connectors 304*a*; the number of light-set connectors 304 may be fewer at the group 310 positioned at the uppermost portion of first tree frame section 112. For example, connector group 310*a* may include eight light-set connectors 304*a* (corresponding to eight branch support arms 148); connector group 310*b* may include eight connectors 304*b*, while groups 310*c* and 310*d* include fewer, such as six connectors 304.

In an embodiment, and as depicted, the number of light-set connectors 304 per group 310 may be the same for each tree frame section and each tree section wiring portion, but may be different from one tree frame section to another. In one such embodiment, first tree section wiring portion 206 includes eight connectors 304 per group 310, while second tree section wiring portion 208 includes six connectors 304 per group 310, and third tree section wiring portion 210 includes four connectors 304 per group 310. In such an embodiment, the number of light-set connectors 304 decreases in quantity per group from one tree section to the next, and from a bottom of tree 100 to a top of tree 100, to accommodate the decreasing quantity of branch support arms 148 (and branches 160) per branch support portion 136.

Second tree section wiring portions 208 and 210 are substantially similar to first tree section wiring portion 206, though the number of connector groups and the number of connectors 304 per group may vary, as may the lengths of wires used.

In an embodiment, second tree section wiring portion 208 includes second tree-section connector 302, a plurality of wires 320, and a plurality of light-set connectors 304 (304*e*-3041). Connector 302 is configured to mechanically and electrically connect to lighting connector 264, thereby connecting second tree section wiring portion 208 to second trunk power subsystem 232.

Wires 320, similar to wires 300, include the plurality of wires, comprising insulated conductors, of second tree section wiring portion 208, including the pair of wires 320*a* and 320*b* connected to connector 302, and the plurality of intermediate wires 300*c* and 300*d* connecting pairs of light-set connectors 304. Certain pairs of intermediate wires 320*c* and 320*d* comprise a pair of group joining wires that join groups of light-set connectors, as will be explained further below. Group-joining wires, in an embodiment, are longer than other intermediate wires 320*c* and 320*d* as group joining wires extend vertically along trunk portion 134 from the vicinity of a lower branch support portion 136 to a relatively higher branch support portion 136. In the embodiment depicted, wires 320 include five pairs of group joining wires, wires 320*e* and 320*f* (three pairs depicted).

In embodiment depicted, second tree section wiring portion 208 is wired in a parallel configuration to provide the same electrical voltage at each light-set connector 304, whether AC or DC. In other embodiments, not depicted, second tree section wiring portion 208 may have a series or series-parallel connection, and hence have a different wiring connection configurations, such that one or more light-set connectors 304 are connected in a series configuration.

In the parallel configuration depicted, wires 320*a*, 320*c* and 320*e* conduct electricity at a first voltage polarity, which may be, e.g., a positive DC voltage or "live" AC voltage, and wires 320*b*, 320*d*, and 320*f* conduct electricity at a second voltage polarity, which may be, e.g., a negative DC voltage, or a "neutral" AC voltage.

Light-set connectors 304, which includes light-set connectors 304*e*-3041, are configured to receive wires 320 and connect to light sets 212. In the parallel embodiment depicted, and with the exception of the last light-set connector 304, each light-set connector 304 receives four wires. For example, a light-set connector 304 may receive two intermediate wires 320*c* and two intermediate wires 320*d*; a "first" light-set connector closest to connector 302, receives wires 320*a*, 320*b* and intermediate wires 320*c* and 320*d*. Embodiments of light-set connectors 304 and received wires are described in further detail below.

Second tree section wiring portion 208 may be defined by distinct groupings of wires 320 and light-set connectors 304, forming connector groups 310, each connector group 310 serving a group of branches 160 of a particular branch support portion 136 (see, also, FIGS. 3 and 4), at a particular trunk location or tree height. In an embodiment, the number of groups 310 corresponds to the number of branch support portions 136, i.e., one group 310 for one branch support portion 136. Groups 310 are electrically connected to each other by group joining wires 320*e* and 320*f*.

In the embodiment depicted, first tree section wiring portion 206 includes six groups 310, namely, group 310*e*-310*j*, corresponding the six branch support portions 136 of second tree frame section 114 (and second tree section 108). Group 310*e* includes a plurality of intermediate wires 320*b* and 320*c*, and a plurality (e.g., six, one for each branch support arm 148) of light-set connectors 304*e*. Groups 310*e*-310*j* include their respective intermediate wires 320*b* and 320*c*, and respective light-set connectors 304*e*-304*j*.

In an embodiment, intermediate wires 320*c* and 320*d* between light-set connectors 304 of a connector group 310, e.g., group 310*e* and connectors 304*e*, define a length sufficient to allow positioning of each individual light-set connector 304 of a group adjacent or near a branch support arm 148 of a branch support portion 136. Consequently, groups 310 are depicted in a ring-like formation as they are intended to be wrapped around trunk portion 174 such that each connector 304 is positioned near a branch support arm 148.

In an embodiment, a length of intermediate wire 320*c* or 320*d* may be substantially equal to one another; in one such embodiment, the length may be substantially equal to a distance $D_{arm2}$ (see, also, FIG. 4) between two adjacent branch support arms 148; in other embodiments, a length of intermediate wire 320*c* or 320*d* may be in a range of +/−10% of the distance $D_{arm2}$ between two adjacent branch support arms; in other embodiments, a length of intermediate wire 320*c* or 320*d* may be in a range of +/−25% of the distance Danny between two adjacent branch support arms; other ranges may also be used. In other embodiments, the length of only some, rather than all, intermediate wires may be the same.

In an embodiment, the relative length of intermediate wires 320*c* and 320*d* of second tree section wiring portion 208 are longer as compared to the length of intermediate wires 300*c* and 300*d* of first tree section wiring portion 208, so as to accommodate variation of spacing between branch support arms 148 in second tree frame section 114 as compared to section 112. Making intermediate wire lengths generally uniform across one tree section, but different from section to section to accommodate changing branch support arm (and branch) spacing, minimizes the use of wire in tree 100, improving the look of the tree and reducing material costs.

As described further below, when attached to second tree frame section 114 (directly or indirectly), intermediate wires 320*c* and 320*d* extend in a direction transverse to, or perpendicular to, the vertical axis A defined by tree 100 and its respective trunk portions. Intermediate wires 320*c* and 320*d* extend generally horizontally in order to extend between branch support arms 148 of a branch support portion 136.

Conversely, and as depicted symbolically in FIG. 5, group joining wires 320*e* and 320*f* extend generally vertically, or generally parallel to vertical axis A of tree 100, or generally transverse to intermediate wires 320*c* and 320*d*. This vertical extension of wires joins one group to another group, for example, connector group 310*e* positioned at a branch support portion 136 to connector group 310*f* at another branch support portion 136.

The number of light-set connectors in each group 310 may be the same, or may vary along a height of tree frame section 114. In an embodiment, and as depicted, all groups 310 of second tree frame section 114 all have the same number of light-set connectors 304 (which, in an embodiment means that each trunk support portion 136 includes the same number of branch support arms, such as eight each).

In another embodiment, the number of light-set connectors 304 (and hence light sets 212) may be greatest at the group 310 positioned at end 170 of second tree frame section 114, which in an embodiment, may be the group closest to connector 302, or group 310*e* with light-set connectors 304*e*; the number of light-set connectors 304 may be fewer at the group 310 positioned at end 172 of second tree frame section 114. For example, connector group 310*e* may include six light-set connectors 304*e* (corresponding to six branch support arms 148); connector group 310*j* may include five connectors 304*j*, while groups 310*c* and 310*d* five or six connectors 304.

As indicated above, in an embodiment, and as depicted, the number of light-set connectors 304 per group 310 may be the same for each tree frame section and each tree section wiring portion, but may be different from one tree frame section to another. In one such embodiment, second tree section wiring portion 208 includes six connectors 304 per group 310, while first tree section wiring portion 206 includes eight connectors 304 per group 310, and third tree section wiring portion 210 includes four connectors 304 per group 310.

In an embodiment, third tree section wiring portion 210 includes third tree-section connector 302, a plurality of wires 340, and a plurality of light-set connectors 304 (304*m* and 304*n*).

Connector 302 is configured to mechanically and electrically connect to lighting connector 292, thereby connecting third tree section wiring portion 210 to third trunk power subsystem 234.

Wires 340, similar to wires 300 and 320, include the plurality of wires, comprising insulated conductors, of third tree section wiring portion 210, including the pair of wires 340*a* and 340*b* connected to connector 302, and the plurality of intermediate wires 340*c* and 340*d* connecting pairs of light-set connectors 304. Certain pairs of intermediate wires 340*c* and 340*d* comprise a pair of group joining wires that join groups of light-set connectors, as will be explained further below. Group-joining wires, in an embodiment, are longer than other intermediate wires 340*c* and 340*d* as group joining wires extend vertically along trunk portion 134 from the vicinity of a lower branch support portion 136 to a relatively higher branch support portion 136. In the embodiment depicted, wires 340 include one pair of group joining wires, wires 340*e* and 340*f*.

In the embodiment depicted, third tree section wiring portion 210 is wired in a parallel configuration to provide the same electrical voltage at each light-set connector 304, whether AC or DC. In other embodiments, not depicted, third tree section wiring portion 210 may have a series or series-parallel connection, and hence have a different wiring connection configurations, such that one or more light-set connectors 304 are connected in a series configuration.

In the parallel configuration depicted, wires 340*a*, 340*c* and 340*e* conduct electricity at a first voltage polarity, which may be, e.g., a positive DC voltage or "live" AC voltage, and wires 340*b*, 340*d*, and 340*f* conduct electricity at a second voltage polarity, which may be, e.g., a negative DC voltage, or a "neutral" AC voltage.

Light-set connectors 304, which includes light-set connectors 304*m* and 304*n*, are configured to receive wires 340 and connect to light sets 212, including depicted light sets 212*e*. In the parallel embodiment depicted, and with the exception of the last light-set connector 304, each light-set connector 304 receives four wires. For example, a light-set connector 304 may receive two intermediate wires 340*c* and two intermediate wires 340*d*; a "first" light-set connector closest to connector 302, receives wires 340*a*, 340*b* and intermediate wires 340*c* and 340*d*. Embodiments of light-set connectors 304 and received wires are described in further detail below.

Third tree section wiring portion 210 may be defined by distinct groupings of wires 340 and light-set connectors 304, forming connector groups 310, each connector group 310 serving a group of branches 160 of a particular branch support portion 136 (see, also, FIGS. 3 and 4), at a particular trunk location or tree height. In an embodiment, the number of groups 310 corresponds to the number of branch support portions 136, i.e., one group 310 for one branch support portion 136. Groups 310 are electrically connect to each other by group joining wires 340*e* and 340*f*.

In the embodiment depicted, third tree section wiring portion 210 includes two connector groups 310, namely, connector group 310*m* and 310*n*, corresponding the two branch support portions 136 of third tree frame section 116 (and third tree section 110). Group 310*m* includes a plurality of intermediate wires 340*b* and 340*c*, and a plurality (e.g., four, one for each branch support arm 148) of light-set connectors 304*m*. Group 310*n* includes its respective intermediate wires 340*b* and 340*c*, and respective light-set connectors 304*n*.

In an embodiment, intermediate wires 340*c* and 340*d* between light-set connectors 304 of a connector group 310, e.g., group 310*m* and connectors 304*m*, define a length sufficient to allow positioning of each individual light-set connector 304 of a group adjacent or near a branch support arm 148 of a branch support portion 136. Consequently, groups 310 are depicted in a ring-like formation as they are intended to be wrapped around trunk portion 184 such that each connector 304 is positioned near a branch support arm 148.

In an embodiment, a length of intermediate wire 340*c* or 340*d* may be substantially equal to one another; in one such embodiment, the length may be substantially equal to a distance $D_{arm3}$ (see, also, FIG. 4) between two adjacent branch support arms 148; in other embodiments, a length of intermediate wire 340*c* or 340*d* may be in a range of +/−10% of the distance $D_{arm3}$ between two adjacent branch support arms; in other embodiments, a length of intermediate wire 340*c* or 340*d* may be in a range of +/−25% of the distance $D_{arm3}$ between two adjacent branch support arms; other ranges may also be used. In other embodiments, the length of only some, rather than all, intermediate wires may be the same.

In an embodiment, the relative length of intermediate wires 340*c* and 340*d* of third tree section wiring portion 210 are longer as compared to the length of intermediate wires 300*c* and 300*d* of first tree section wiring portion 208, and/or the length of intermediate wires 320*c* and 320*d* of first tree section wiring portion 206, so as to accommodate variation of spacing between branch support arms 148 in third tree frame section 116 as compared to sections 114 and 112, and an assembled tree trunk having a substantially uniform diameter when assembled.

As described further below, when attached to second tree frame section 114 (directly or indirectly), intermediate wires 340*c* and 340*d* extend in a direction transverse to, or perpendicular to, the vertical axis A defined by tree 100 and its respective trunk portions. Intermediate wires 340*c* and 340*d* may extend generally horizontally in order to extend between branch support arms 148 of a branch support portion 136.

Conversely, and as depicted symbolically in FIG. 5, group joining wires 340*e* and 340*f* extend generally vertically, or generally parallel to vertical axis A of tree 100, or generally transverse to intermediate wires 340*c* and 340*d*. This vertical extension of wires joins one group to another group, for example, connector group 310*m* positioned at a branch support portion 136 to connector group 310*n* at another branch support portion 136.

The number of light-set connectors in each group 310 may be the same, or may vary along a height of tree frame section 116. In an embodiment, and as depicted, all groups 310 of third tree section wiring portion 210 and third tree frame section 114 all have the same number of light-set connectors 304 (which, in an embodiment means that each trunk support portion 136 includes the same number of branch support arms, such as four each).

In another embodiment, the number of light-set connectors 304 (and hence light sets 212) may be greatest at the group 310 positioned at end 180 of second tree frame section 116, which in an embodiment, may be the group closest to connector 302, or group 310*m* with light-set connectors 304*m*; the number of light-set connectors 304 may be fewer at the group 310 positioned at end 182 of second tree frame section 116. For example, connector group 310*m* may include four light-set connectors 304*m* (corresponding to four branch support arms 148); connector group 310*n* may include three connectors 304*n*.

As indicated above, in an embodiment, and as depicted, the number of light-set connectors 304 per group 310 may be the same for each tree frame section and each tree section wiring portion, but may be different from one tree frame section to another. In one such embodiment, third tree section wiring portion 210 includes four connectors 304 per group 310.

In an embodiment, the current-carrying capacity, ampacity, or combined diameter of conductors of wires 300, 320 and 340 may be less than that of wires 240, 260 and 290 of trunk power subsystems 230, 232 and 234. Generally, wires 240, 260 and 290 of trunk power subsystems 230, 232 and 234 transmit more electrical power or current as compared to wires 300, 320 and 340 of the trunk section wiring portions 206, 208 and 210. Consequently, lower-gauge wires may be used for wires 300, 320 and 340 as compared to wires 240, 260 and 290. Further, and as will be described further below, wires used for light sets 212 will have an even lower current transmission requirement, and may thusly have a wire size even less than wires 300, 320 and 340, such that three different wire gauges are used in tree 100. In an embodiment, wires 240, 260 and 290 all employ 20 gauge (AWG) wires, wires 300, 320 and 340 employ 22 AWG wires, and light sets employ 25 AWG wires (or even smaller).

Still referring to FIG. 5, tree lighting system 200 includes a plurality of light sets 212. In an embodiment, the number of lights or LEDs per light set 212 varies. Generally, for portions of tree 100 having relatively long branches, for example, first tree section 104 with first tree frame section 112, light sets 212 may be generally longer, and include more lights 110 per light set; for portions of tree 100 having relatively shorter branches, such as third tree section 108 with third tree frame section 116, may have shorter light sets.

In an embodiment, and as depicted tree lighting system 200 includes light sets 212, which includes a plurality of light sets 212*a* having 16 lights or LEDs per set, light sets 212*b* having 12 lights per set, light sets 212*c* having 10 lights per set, light sets 212*d* having 8 lights and light sets 212*e* having 6 lights per set. In other embodiments, the number of lights or LEDs 110 may be greater of fewer depending on branch 160 size, including length and/or width and number of branch tips, as well as desired lighting density (higher density, more lights per set).

As will be described further below, each light set 212 includes a plurality of lights or LEDs 110, conductors 360 and 362, and a light-set connector portion 305. A light-set connector portion 305 may be a portion of a light set connector 304, or may form a distinct connector. Each light-set connector portion 305 is configured to couple to a light-set connector 304 to mechanically and electrically connect a light set 212 to a corresponding tree section wiring portion.

Each light set 212 also includes a pair of wires or conductors, 360, 362. In an embodiment, each of conductors 360 and 362 comprise a single-strand conductor. In other embodiments, conductors 360 and 362 comprise multi-strand conductors.

Figure 6:
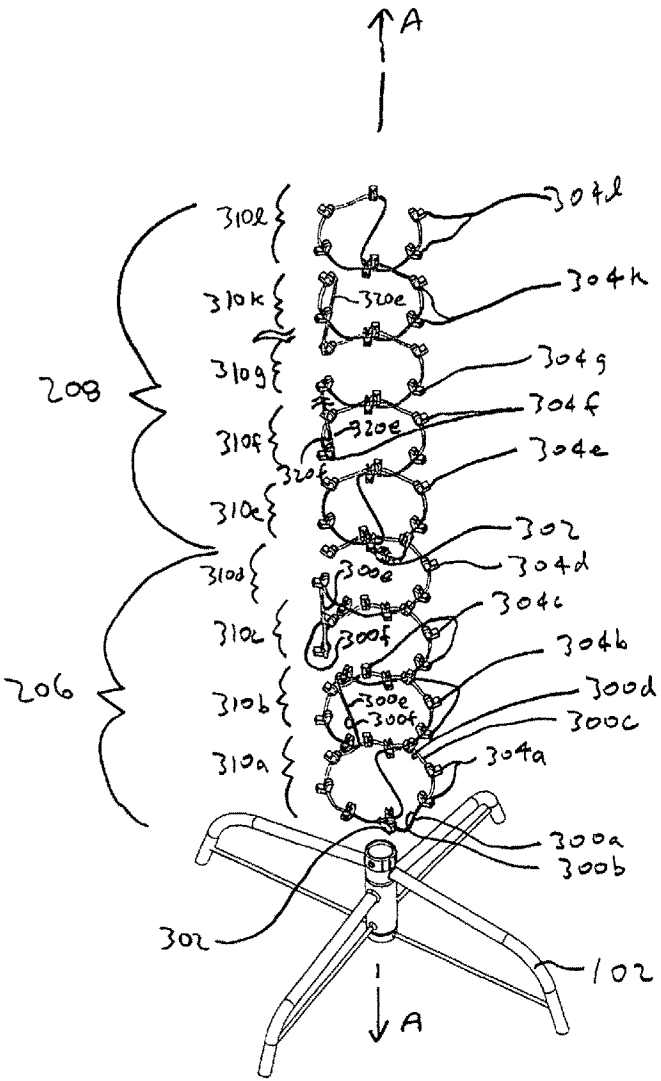
FIG. 6 is a front, perspective view of a tree base with portions of a tree-lighting system positioned above the base, according to an embodiment.

Referring to FIG. 6, first and second tree section wiring portions 206 and 208 are depicted relative to tree stand 102, in a perspective view. In this depiction, first and second tree frame sections 112 and 114 are not depicted, though tree section wiring portions 206 and 208 are depicted as if they were assembled onto tree frame 120. Third tree section wiring portion 310 is not depicted for simplicity, but will be understood to be positioned similarly to portions 206 and 208, and at a position above portion 208 relative to axis A.

Figure 7:
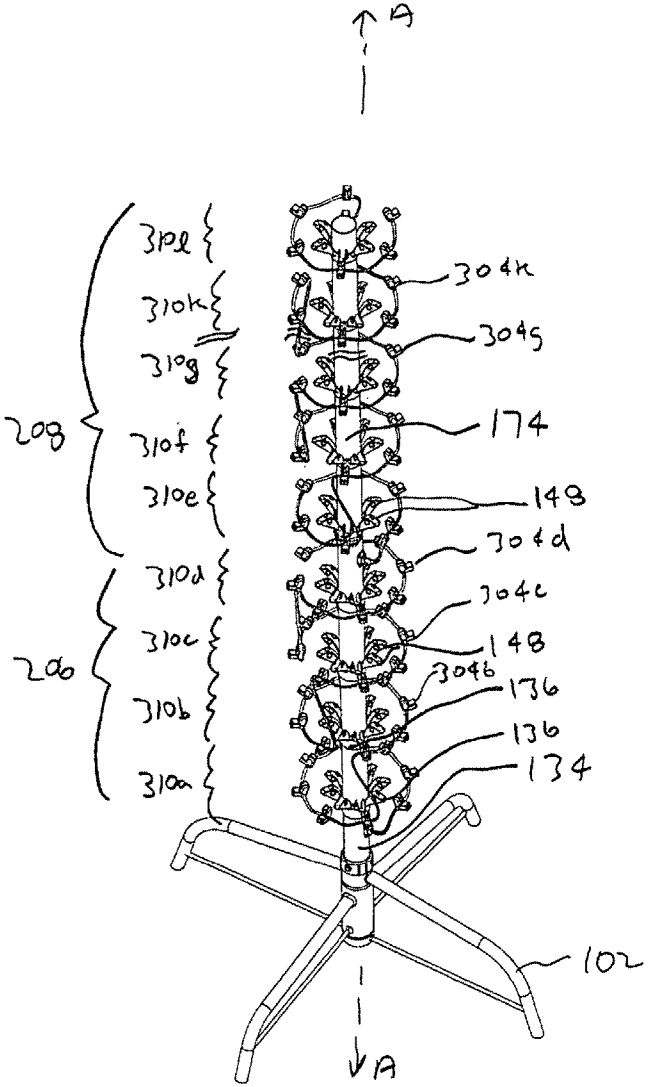
FIG. 7 is the tree base and portion of the tree-lighting system depicted in FIG. 6, with a tree trunk.

Referring also to FIG. 7, trunk portions 134 and 174 with branch support portions 136 and branch support arms 148 are added to the depiction of FIG. 6, to depict positioning of first and second tree section wiring portions 206 and 208 relative to trunk portions 134 and 174.

In an embodiment, each tree section wiring portion, including depicted portions 206 and 208, all or a portion thereof, are wound generally helically about vertical axis A and trunk portions 134 and 174. Each connector group 310, including connector groups 310*a*-3101 as depicted, are each positioned at a unique height, or relative position along axis A, which also corresponds to a branch support portion 136. Each group 310 extends horizontally and circumferentially about axis A and its respective trunk portion. Connector groups 310 are connected to one another by group-joining wires 300*e, f* and 320*e, f*, which extend vertically, parallel to axis A and trunks 134 and 174.

In an embodiment, each light-set connector 304 is positioned adjacent to, or near, a branch support arm 148. In the depicted embodiment, light set connectors 304 form an L shape and receive two wires into opposite sides of a connector body. However, other, alternative light-set connectors having different constructions comprise embodiments of the various tree section wiring portions, some of which are described further below.

Figure 9:
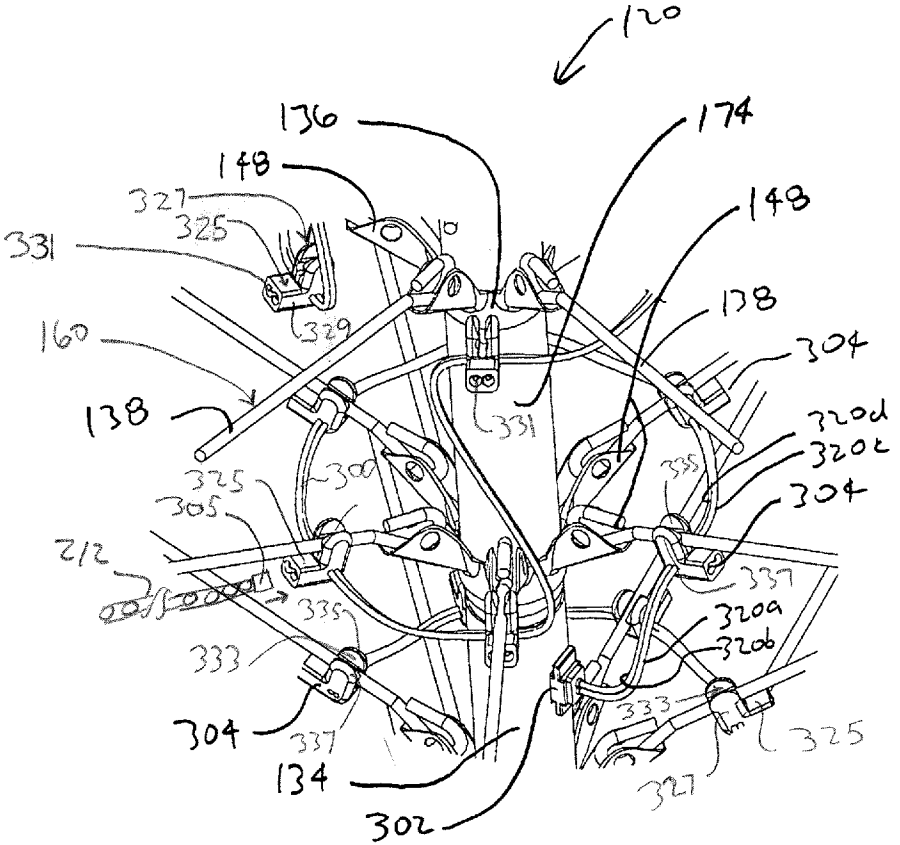
FIG. 9 is a view of a portion of the depiction of FIG. 8.
Figure 8:
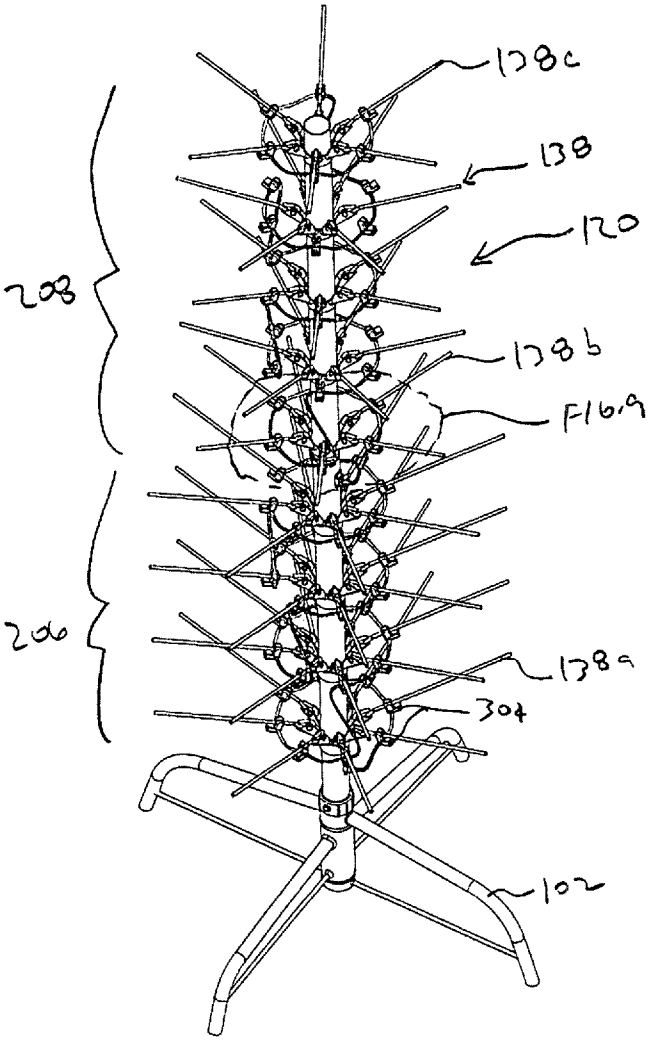
FIG. 8 is the tree base, portion of the tree-lighting system and tree trunk depicted in FIG. 7, with branch support portions and portions of branches.

Referring also to FIGS. 8 and 9, branch portions 138 are added for perspective, and to also depict that an embodiment that includes light-set connectors 304 that connect to, or are somehow affixed to (via clips, connectors, cable ties, etc.) to branch portions 138 (or to other portions of branches 160 not shown, including sub-branches and leaves or needles). In this depiction, branch portions 138 include pluralities of branch portions 138*a*, 138*b* and 138*c*, wherein branch portions 138*a* are longer than branch portions 138*b* and 138*c*, and branch portions 138*c* are shorter than branch portions 138*a* and 138*b*, with the longest branches near a bottom of tree frame 120 and the shorter branches near the top of tree frame 120.

In an embodiment, light-set connectors 304 are configured to be attached to a branch portion 138 or branch 160. In the embodiment depicted each light-set connector 304 is configured to attach to a branch portion 138 that comprises a rod or shaft that serves as the main support for a branch 160. In an embodiment, and as depicted branch portion 138 has a circular cylindrical cross-sectional shape, and extends from branch support 136 as described above.

In an embodiment, light-set connector 304 includes light-set connecting portion 325 and branch-connecting portion 327. In an embodiment, light-set connector 304 may be L-shaped as depicted, with branch-connecting portion 327 extending outwardly and away from light-set connecting portion 325, and light-set connecting portion 325 extending in a direction generally parallel with branch portion 138. In an embodiment, and as depicted, light-set connecting portion 325 and branch-connecting portion 327 form an integral light-set connector 304. In one such embodiment, light-set connecting portion 325 and branch-connecting portion 327 comprise a polymer material commonly molded, such as by injection molding. In other embodiments, light-set connecting portion 325 and branch-connecting portion 327 may be separately manufactured components that are assembled together. In one such embodiment, light-set connecting portion 325 may form a connector that makes an electrical and mechanical connection between power wires 300 and light set 212 wires, while branch-connecting portion 327 forms a mechanical connector that connects light-set connecting portion 325 to a branch portion 138.

In an embodiment, light-set connecting portion 325 includes body portion 329 that defines receiving cavity 331 for receiving a portion of a light set 212. The portion of the light set 212 that may be received by light-set connecting portion 325 may include a corresponding connector of a light set 212 or may simply include the wires of light set 212. Connectors, wires, and other elements of light set 212 are described further below, including further below with respect to FIGS. 12-28.

In an embodiment, light-set connecting portion 325 receives a portion of the wires that provided power to individual light sets 212, wires 300, and is in electrical connection with the conductors of wires 300. Light-set connecting portion 325 may include electrical terminals or other conductive components that electrically connect to the conductors of wires 300, and that are configured to connect to terminals or conductors or wires of a light set 212 so as to make an electrical connection between wires 300 and light set 212.

In an embodiment, light-set connecting portion 325 may include wire-piercing terminals for use with a twin-wire or parallel wire set of wires 300. In such a configuration, a pair of wires of wires 300 are connected side-by-side via an insulative coating, such as PVC, and may enter and exit body portion 329 of light-set connecting portion 325. Embodiments of wire-piercing terminals and associated connectors for piercing side-by-side parallel wires are disclosed in U.S. Pat. No. 8,562,175 "Wire-Piercing Light-Emitting Diode Illumination Assemblies", issued Oct. 22, 2013, and which is incorporated by reference herein in its entirety.

In an embodiment, a portion of clip 304, such as light-set connecting portion 325 may extend in a direction generally parallel with a branch portion 138, and cavity 329 may have an opening or entrance that faces a direction generally parallel with, or along an axis of, the branch portion or shaft 138, as depicted. In such an embodiment, when light-set connecting portion 325 receives an end of a light set 212, the wires of light set 212 naturally extend also in a direction substantially, or generally parallel with the axis of the branch portion 138, thereby avoiding bending wires of light set 212, such as wires 360 and 362. Avoiding bending light set 212 wires decreases the possibility of wires breaking due to bending during assembly. This is particularly true of single-conductor light set wires.

In an embodiment, branch-connecting portion 327 defines branch-receiving channel 333, or branch-shaft-receiving channel 333. Branch-receiving channel 333 is configured to receive a portion of a branch, which in an embodiment is a branch portion 138 comprising a branch shaft. In one embodiment, branch-receiving channel 333 defines a U shape or a C shape, or otherwise defines a channel that is open at both ends as well as along its length. In other embodiments, branch-receiving channel 333 defines a through hole through which a branch shaft is inserted. In the embodiment depicted, branch-receiving channel 333 forms a channel configured to receive a portion of branch portion 138 and to clip branch-connecting portion 327 to branch portion 138. In one such embodiment, a lengthwise opening of channel 333 is narrower than a lengthwise interior portion of channel 333, the opening of the channel 333 being narrower than a diameter of branch portion 138, such that opposing portions 335 and 337 of branch-connecting portion 327 must flex away from one another when a branch portion 138 is pressed into, or otherwise inserted into, channel 333.

In other embodiments, pins, connecting structure, or other means may be used to connect portions of branch-connecting portion 327 to a branch portion 138.

Although branch-connection portion 327 and light-set connecting portion 325 of connector 304 are depicted as being assembled so as to be located underneath a branch portion 138, it will be understood that connector 304 could be connected at any relative position about a circumference of branch portion 138. In one such embodiment, light-set receiving portion 325 is located atop branch portion 138.

Figure 10:
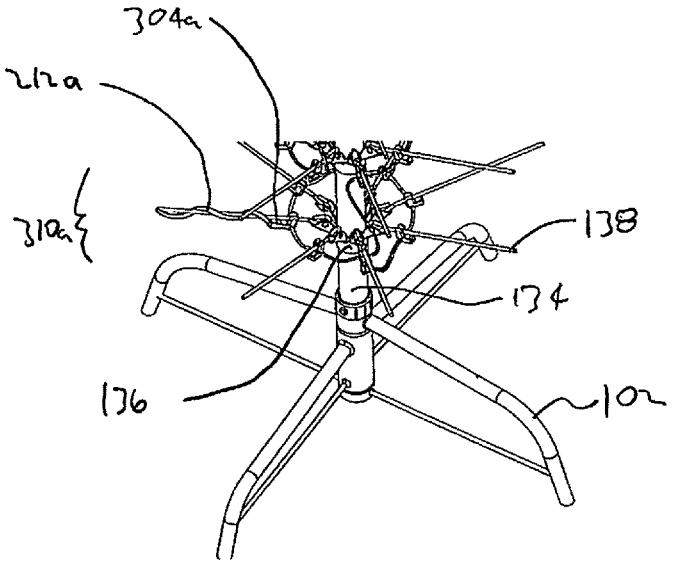
FIG. 10 is front, perspective view of a portion of a tree frame section inserted into a tree base, with a portion of a tree-lighting system, including a light set, depicted, according to an embodiment.

Referring also to FIG. 10, a light set 212 is depicted in connection with a light-set connector 204, and more specifically, light set 212*a* connected to light-set connector 304*a*.

Figure 11:
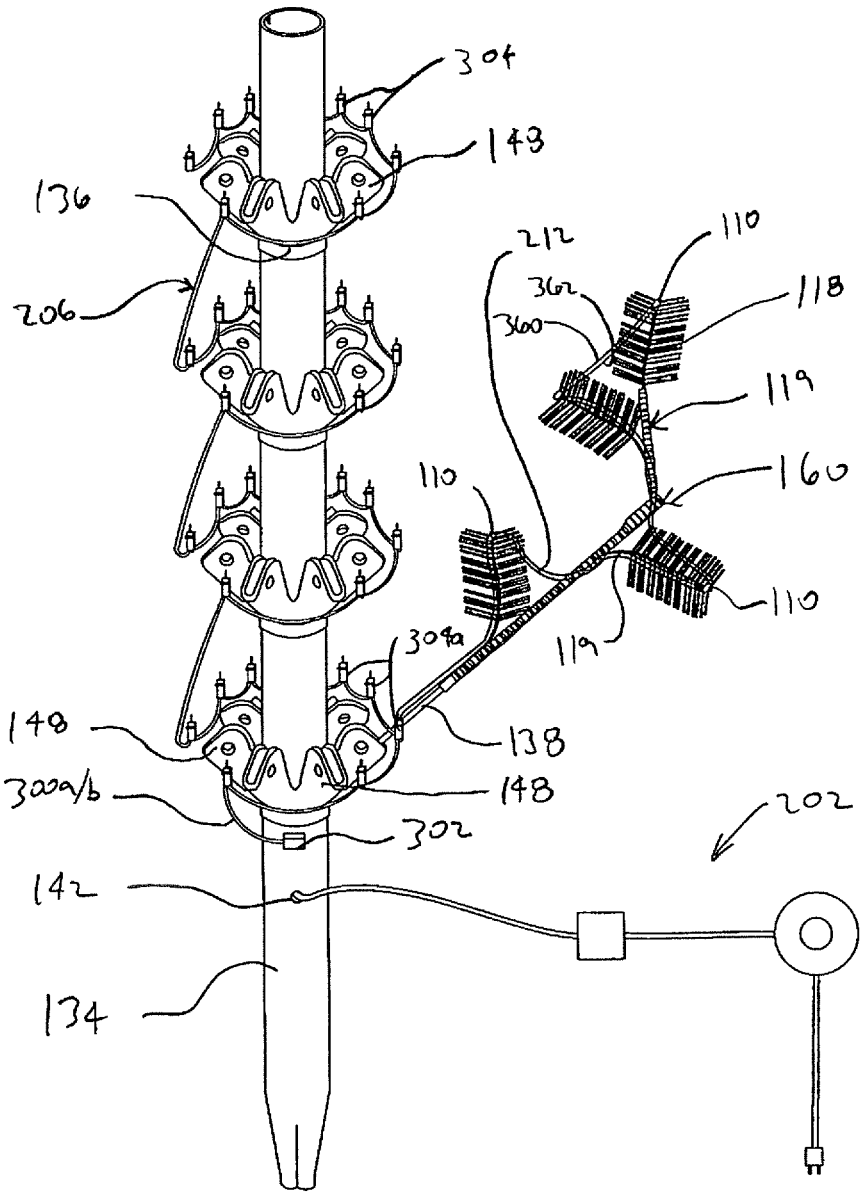
FIG. 11 is a front, perspective view of a tree frame section with a portion of a tree-lighting system.

Referring to FIG. 11, a light set 212 is depicted as connected to a light-set connector 204 and distributed about a branch 160 with artificial needles 118 on sub-branches 119. As described above, branch 160 with its branch portion 138 is pivotally connected to branch arm support 148 of branch support portion 136. In an embodiment, branch 160 is not removably affixed to branch support portion 136, but rather is affixed in a manner such that it cannot be removed or replaced without damaging branch 160, support 136 or other surrounding structure.

First trunk section wiring portion 206 of tree lighting system 200 is wrapped about first tree frame section 112 (only one branch 160 depicted for the sake of illustration). In this embodiment, first tree section wiring portion 206 includes an alternate embodiment of light-set connectors 204, described further below.

LEDs 110 light set 212 are distributed about branch 160, with LEDs 110 positioned at the tips of sub-branches 119. As depicted, light set 212 is positioned only on a single branch 160. In an embodiment, a single light set 212 is positioned or located on a single branch. In other words, each light set 212 is only attached to one branch, and does not extend from one branch to another branch, including not extending to other branches above, below or adjacent to the branch that the light set 212 is affixed to. This feature is not found in traditional lighted artificial trees with traditional lights strings that span from branch to branch. In tree 100, each light set 212 is selected, e.g., light set 212*a* with a first length and number of lights or LEDs 110 or light set 212*b*, being shorter and with fewer lights 110, based in part upon branch size, which may include branch length. Such a feature allows branch 160 to be sufficiently "covered" with lights 110, but at the same time, allowing only one light set 212 per branch 160.

Limiting each light set 212 to a single branch, and eliminating extension of light set 212 between branches, the wires of light sets 212 are not subjected to the stress and strain that would otherwise be inflicted upon the set due to pivoting of branches. For example, if a light set 212 were to span across two branches, as is commonly done in known trees, and one branch were pivoted upward, while the other branch held stationary, the wiring that extends between the two branches would be pulled, possibly resulting in the wire breaking or otherwise disconnecting from the light set.

Tree lighting system 200 with its 3-tiered wiring system that includes trunk power subsystems, tree frame section wiring portions and individual light sets facilitates the isolation of single light sets on single branches. Further, because each light set 212 is affixed to a branch 160, and therefore is supported by its respective branch, lighter, smaller wires can be used for each light string or set 212. This is particularly useful and efficient when LEDs 110 are used in light sets 212. Generally, LEDs require less current to operate, so smaller gauge wires can be used. Further, because light sets 212 are limited to a single branch, the number of LEDs 110 for a single light set 212 is relatively small, further limiting the current flow through light set 212. In an embodiment, the number of LEDs 110 per light set 212 ranges from 6 to 16. In other embodiments, the number of LEDs 110 per light set 212 ranges from 4 to 20; in another embodiment, 4 to 40, or even 4 to 80 LEDs, which may be appropriate for larger trees with higher light density. In some embodiments, due to elimination of risk of bending and flexing light set 212 wires, and the low current draw per light set 212, light sets 212 may use particularly-thin single strand conductors, previously considered to light and fragile to be used on lighted trees with pivotable branches, thereby providing significant material savings.

Tree section wiring portions, such as 206, 208 and 210 described herein, enable using one light string 212 per branch 160 by providing a means for connecting each individual light string 212 to a power supply, e.g., via connector 304, wires 300, connector 302 of wiring portion 206 and trunk power subsystem 230.

Referring to FIGS. 12-16, several embodiments of light sets 212 are depicted.

Figure 12:
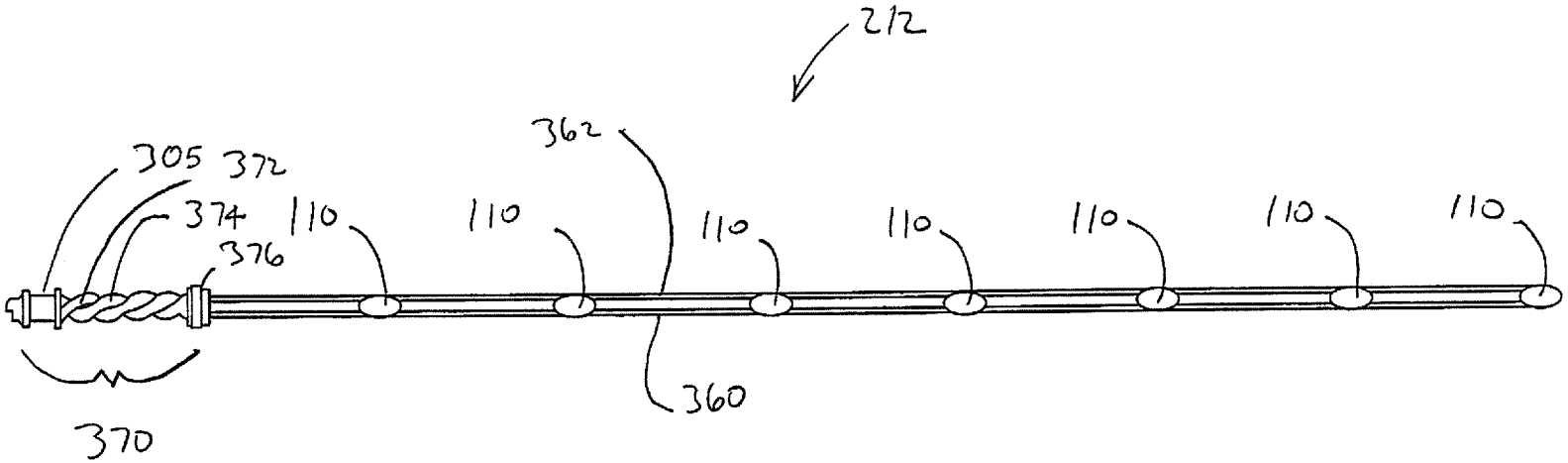
FIG. 12 is a front view of a light set, according to an embodiment.

Referring specifically to FIG. 12, an embodiment of light set 212 is depicted. In this embodiment, light set 212 includes connector system 370, wires 360 and 362, and a plurality of LED assemblies 110. In the embodiment depicted, light set 212 includes six LED assemblies 110, but it will be understood that light set 212 may include fewer or more LED assemblies 110 as described above. In an embodiment, wire 360 conducts electricity having a first polarity, such as a positive DC voltage, and wire 362 conducts electricity having a second polarity, such as a negative DC voltage.

In an embodiment, each of wires 360 and 362 comprise a single strand conductor coated with an insulating material. Some such single strand conductors are known in the industry as enameled wire or "magnet" wire, often used for windings in electromagnets, transformers, and so on. In embodiments, wires 360 and 362 may comprise a copper or aluminum material, or a metal alloy comprising any of copper, aluminum, nickel, steel, and others. As will be understood by those familiar with magnet wire, the wire tends to be very brittle and easily broken. However, due to the protective design features of tree lighting system 200, magnet wire may be used in light sets 212 without significant risk of breakage.

Figure 13:
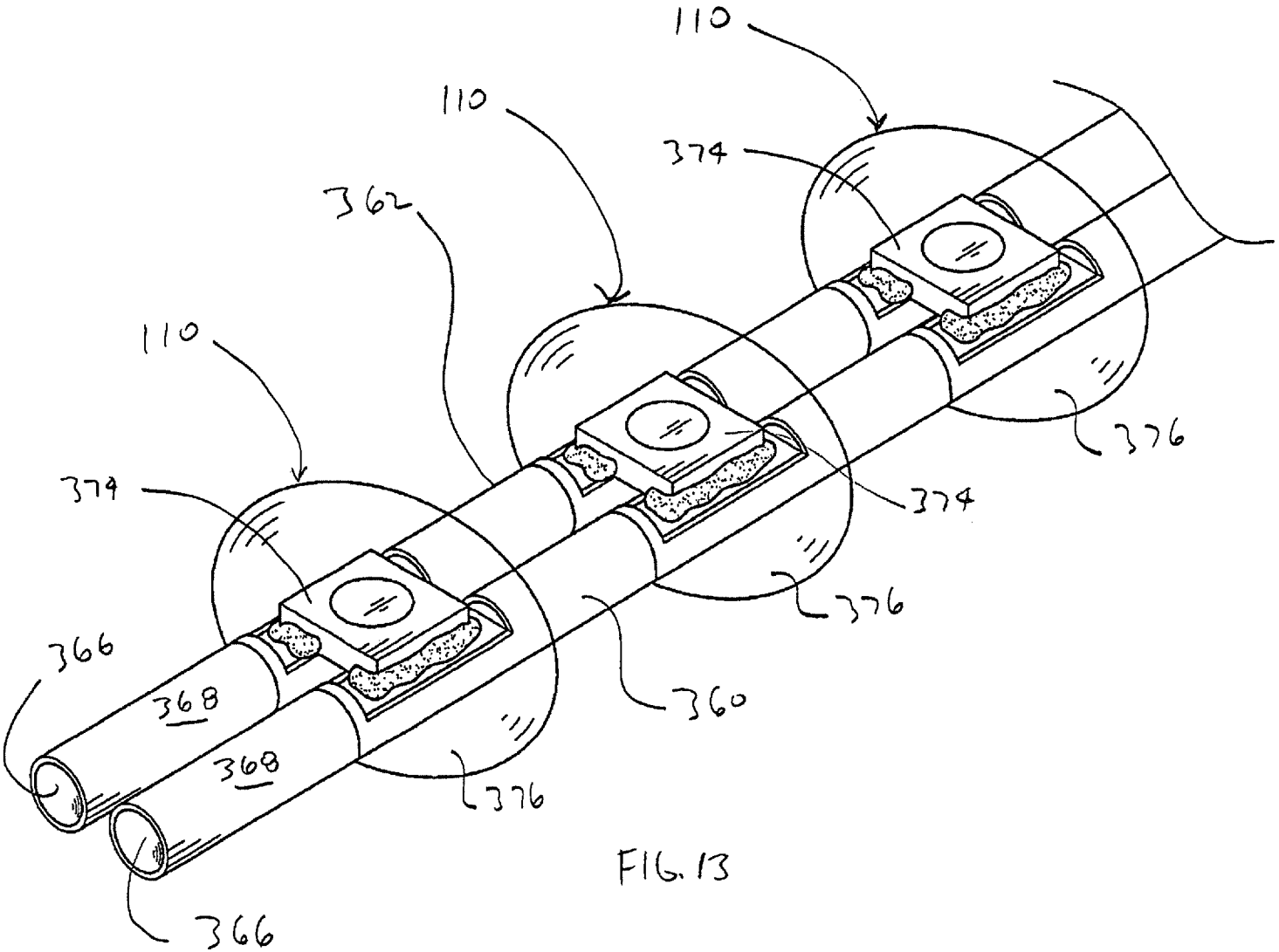
FIG. 13 is a front, perspective view of a portion of a light set, according to an embodiment.

Referring also to FIG. 13, an embodiment of a portion of the light set 212 of FIG. 12 is depicted. In this embodiment, each of wires 360 and 362 include a single-strand conductor 366 coated with an insulative coating 368. In an embodiment, wires 360 and 362 are each continuous wires extending from one end to another end of light set 212, connecting each of LEDs 110, rather than each comprising a plurality of wire segments between each LED 110. LEDs 110 each comprise an LED chip 374, which may be a surface-mount LED chip as depicted. LED chip 374 is electrically connected to conductors 366. A layer of epoxy or other translucent, transmissive or similar material 376 covers each LED 110, forming a protective layer around each LED chip 374 and its connections to conductors 366. Epoxy layer 376 also forms a lens for LED 110. Similar constructions are known in the art and described in U.S. Pat. No. 7,926,978 to Tsai, entitled "Light Set with Surface Mounted Light Emitting Components", which is herein incorporated by reference in its entirety.

Additional embodiments of light sets 212 are described and depicted in U.S. Application 62/466,547 and 62/466,646, to which the instant application claims priority, and which are herein incorporated by reference.

In an embodiment, light sets 212 may be manufactured from a very long, continuous set of lights comprising wires 360, 362 and LEDs 110. In such an embodiment, the spacing between LEDs 110 is uniform, and portions of the continuous light set are cut to a desired length or LED count from the longer, continuous set of lights as part of the manufacturing process.

It will be understood that although embodiments of wires 360 and 362 include single-strand conductors, such as magnet wire, other embodiments of wires 360 and 362 may include more traditional wire types, including multi-strand wires, though generally in a smaller gauge as compared to traditional light sets.

In the embodiment depicted, light set 212 includes a transitional connector system 370 for connecting the magnet-wire portion of light set 212 to a tree section wiring portion, such as one of portions 206, 208 or 210. In the embodiment depicted connector system includes connector 304 (see also FIG. 5), a wire pair that includes insulated conductor wires 372 and 374, and connector 376. In an embodiment, and as depicted, wires 372 and 374 may comprise traditional insulated wires, such as 22 or 25 AWG or other gauge CXTW wires.

In an embodiment connector 305 is configured to couple to connector 304 of a tree frame wiring section, thereby making a mechanical and electrical connection between a light set 212 and a tree frame wiring section. In an embodiment, connector 305 may comprise any of many known connectors that include plastic body portions and multiple electrical terminals that make an electrical connection with conductors of insulated wires.

In an embodiment, "connector" 376 may comprise a traditional known connector such as connector 305, but modified to handle the smaller size of wires 362, but alternatively, may comprise a "connection system", that includes a soldered connection between wires 372 and 360 and between wires 374 and 362, each soldered connection covered by an insulative sleeve, such as a "shrink wrap" sleeve as is known in the industry. Consequently, connector 376 provides a connection between a pair of wires 360, 362 having a small conductive diameter, and two larger wires of a different type, wires 372, 374.

Figure 14:
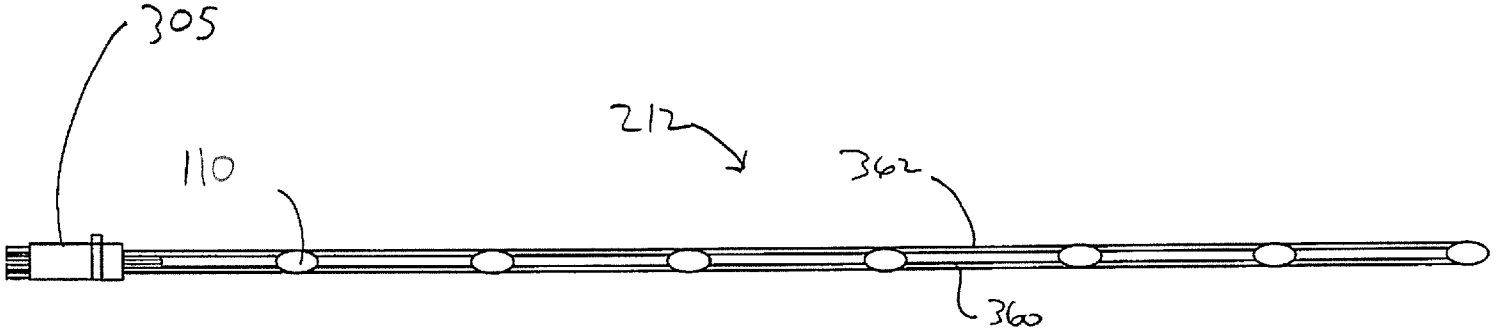
FIG. 14 is a front view of a light set, according to another embodiment.

Referring to FIG. 14, another embodiment of a light set 212 is depicted. In this embodiment, a connector 304 is directly coupled to wires 360 and 362 of light set 212. Unlike the light set 212 of FIG. 12, the light set 212 of FIG. 14 does not require the transitional connector system 370, but rather, a mechanical connection is made between electrical terminals inside connector 304 and end portions of wires 360 and 362, thereby also making an electrical connection between wires. Such a mechanical connection avoids the traditional method of soldering wires of disparate sizes together. An embodiment of connector 305 is depicted in FIGS. 19-28, and described further below.

Figure 15:
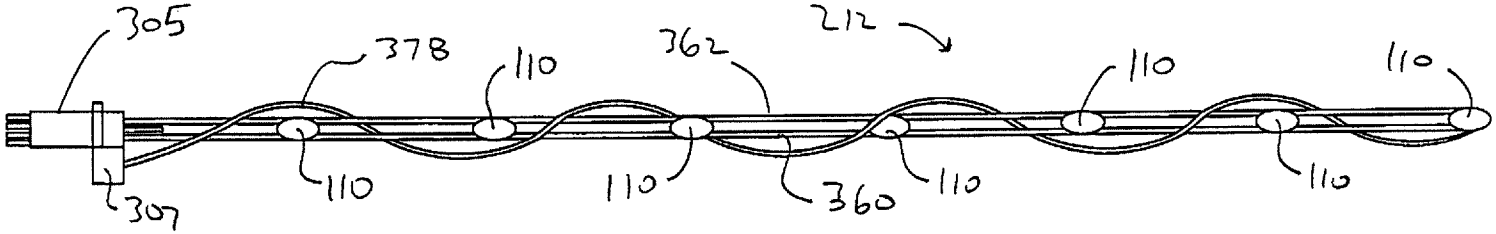
FIG. 15 is a front view of a light set, according to another embodiment.
Figure 16:
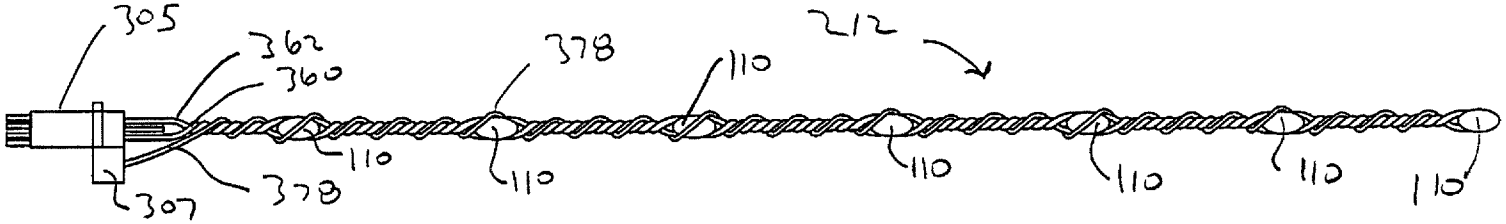
FIG. 16 is a front view of a light set, according to another embodiment.

Referring to FIGS. 15 and 16, additional embodiments of a light set 212 are depicted. The light sets 212 of FIGS. 15 and 16 are similar to the light set 212 of FIG. 13, except that light set 212 of FIGS. 15 and 16 include a reinforcing or supporting strand wrapped about conductors 360 and 362. Connector 305 also includes additional structure for anchoring an end of a segment of a reinforcing or supporting strand 378.

In an embodiment, and as depicted, reinforcing strand 378 is anchored to connector 305 and an end, then wrapped about conductors 360 and 362. In the embodiment of FIG. 15, conductors 360 and 362 are generally not twisted about one another in the embodiment depicted. Supporting strand 378 adds to the strength of light set 212 with respect to any longitudinal pulling force that might accidentally be applied to the relatively small diameter wires 360 and 362. Such pulling force might be the result of a user tugging on light set 212 while attached to a branch 160. The use of a reinforcing or supporting strand 378 may be more useful as the conductor diameter of wires 360 and 362 decrease, and in particular, when single-strand, small conductor size magnet wires are used.

In the embodiment depicted in FIG. 16, not only is supporting strand 378 twisted about conductors 360 and 362, but conductors 360 and 362 are also twisted about one another.

In an alternate embodiment, a reinforcing or supporting strand 378 may be integrated into a wire 360 and/or a wire 362. In one such embodiment, one or more strands 378 may be intertwined with, or wrapped about, conductors 366, with insulating material covering both the reinforcing strand and the conductors. Embodiments of wires with integrated reinforcing strands are further described in U.S. Pat. No. 9,243,788 to Chen, entitled "Decorative Lighting with Reinforced Wiring", which is incorporated by reference herein in its entirety.

Figure 16A:
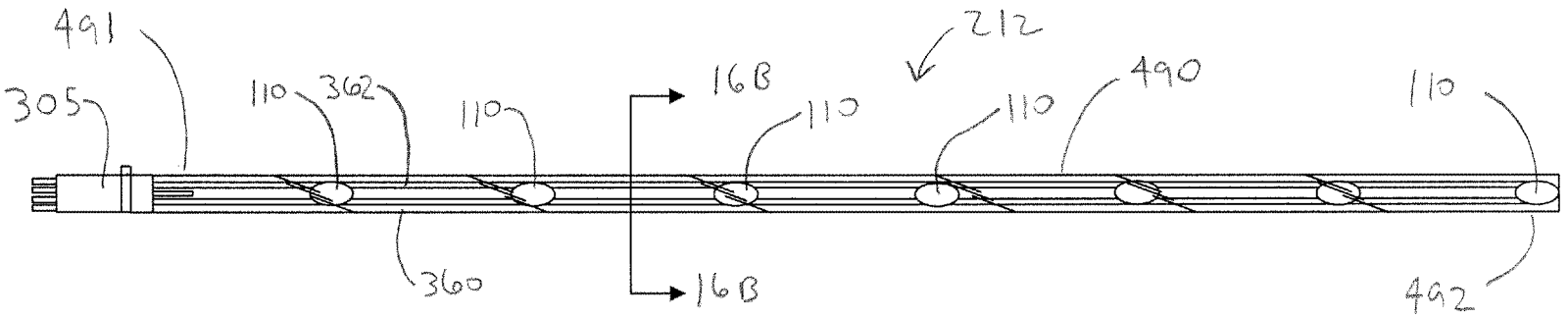
FIG. 16A is a front view of a light set with a tube covering, according to another embodiment.
Figure 16B:
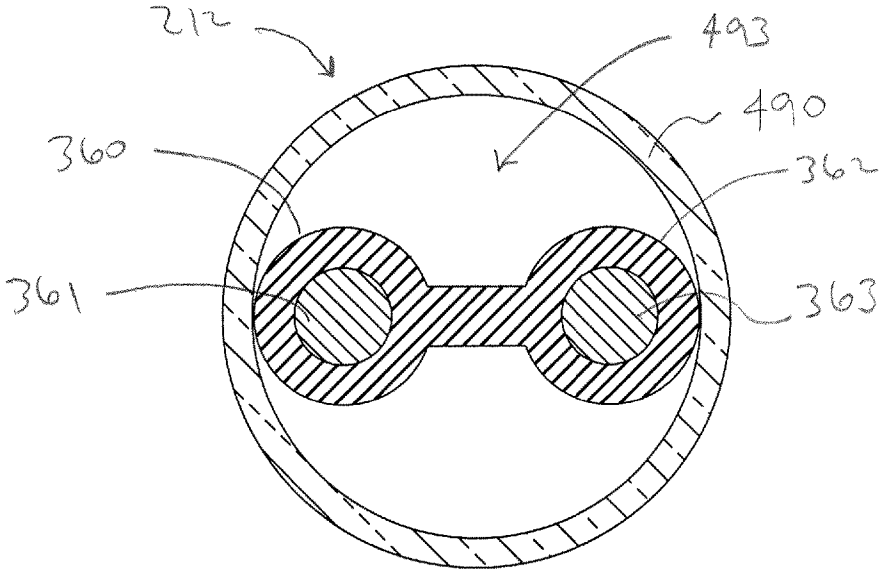
FIG. 16B is a cross-section of the light set with a tube covering, according to FIG. 16*a;*

Referring to FIGS. 16A and 16B, an embodiment of a light set 212 is depicted. In this embodiment, light set 212 includes an external tube 490 substantially covering wires 360 and 362, and LEDs 110. In an embodiment, tube 490 includes first or connector end 491 and second or free end 492. In an embodiment, first end 491 is adjacent connector 305, and in some embodiments, is structurally connected to connector 305, such as via insertion into connector 305, or via other means. In an embodiment, first end 491 is open, rather than blocked, plugged or otherwise sealed closed. In an embodiment, second end 492 is an open end. Because in an embodiment, wires 360 and 362 are insulated, tube 490 provides a form of physical protection to wires 360 and 362, but does not need to be water tight. In some applications, having an open ends allows water entering tube 490 to drain out another end.

In an embodiment, tube 490 comprises a flexible material, such as a polymer. In one such embodiment, the polymer comprises a polyvinyl chloride (PVC) material. In an embodiment, tube 490 comprises a clear or a transparent material. In other embodiments, tube 490 comprises a translucent or partially transparent material. In any case, light emitted from LEDs 110 may be transmitted fully or partially through tube 490 so as to be visible to a viewer of light set 212.

Referring specifically to FIG. 16B, in an embodiment, tube 490 is a polymer material that is extruded over LED assemblies 110 and wires 360 and 362, leaving cavity 493, such that wires 360 and 362 extend inside tube 490 along its length, and inside cavity 493. In an alternate embodiment, tube 490 may not define a cavity 493, though including a cavity saves on tube material.

In the embodiment depicted, and as described above with respect to the previous figures, wires 360 and 362 include a conductor portion 361 and 363, respectively, with each conductor portion covered with an insulative polymer coating 365, which may be a PVC material, and may include flame-retardant properties. In an embodiment, each conductor portion 361 and 363 comprises a single-strand conductor, which may be copper. In other embodiments, conductor portions 361 and 363 may comprise multi-strand conductors.

As mentioned above, tube 490 provides a protective layer over wires 360, 362 and LED assemblies 100, serving to protect the light set subassembly of wires and lights. This can be particularly advantageous when wires 360 and 362 use small gauge, single-strand conductors that may be susceptible to breakage when flexed or otherwise moved. Depending on tube material, tube 490 also provides a particular lighting effect by refracting or reflecting light emitted from LEDs 110.

In an embodiment of a manufacturing method, portions of insulation of wires 360 and 362 are removed, LED chips are attached to conductors of wires 360 and 362, a lens is formed around each LED chip, in a continuous fashion to form long lengths of wires with LED assemblies. The preassembled wires with LED assemblies are then subjected to a process whereby tube 490 is continuously extruded over a length of the preassembled wires with LED assemblies to form the light set 212 with tube 490. The wires with LEDs and tube 490 may be cut to any desired length, and a connector 305 is attached to complete the light set 212.

Figure 17:
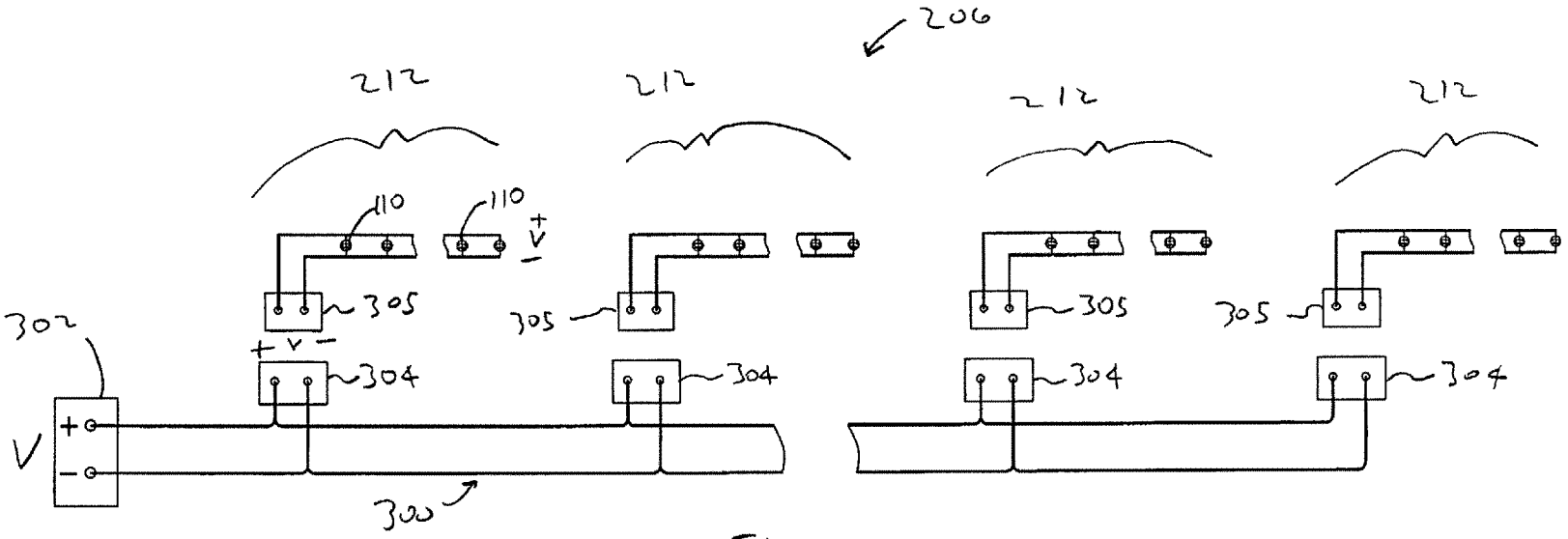
FIG. 17 is a block diagram of a tree section wiring portion, with LEDs of a light set electrically connected in parallel, and light sets connected in parallel with one another.
Figure 18:
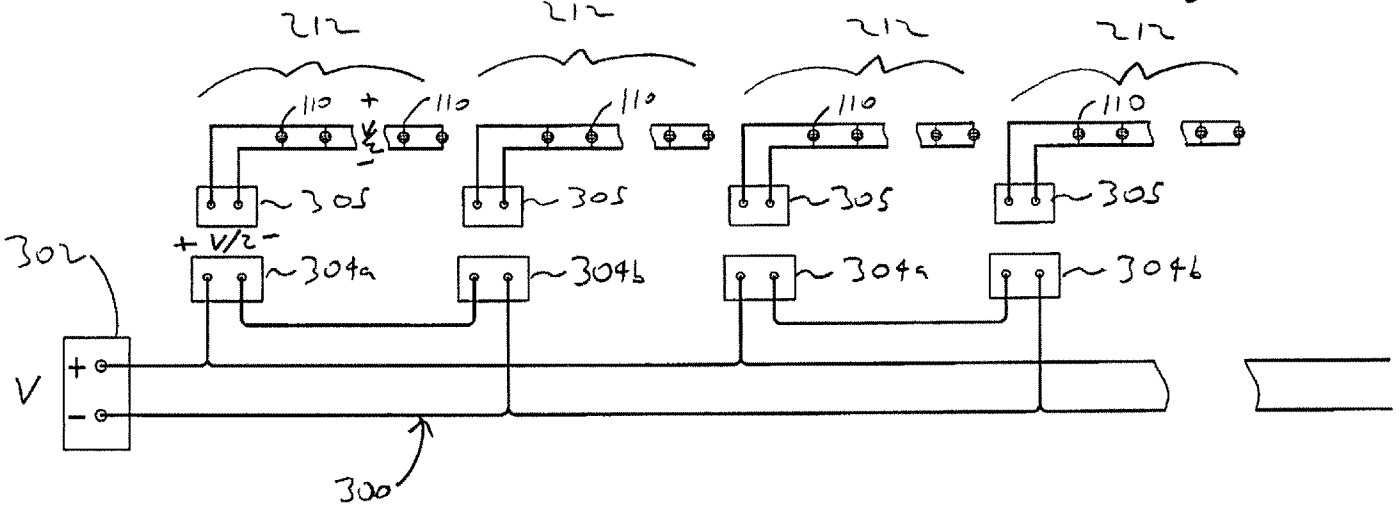
FIG. 18 is a block diagram of a tree section wiring portion, with LEDs of a light set electrically connected in parallel, and selected light sets connected in series with one another such that the light sets are electrically connected in a series-parallel configuration.

Referring to FIGS. 17 and 18, simplified electrical circuit diagrams of two embodiments of a tree section wiring portion, which represents any of first, second or third tree section wiring portions 206, 208 or 210, with light sets 212, are depicted.

Referring specifically to FIG. 17 a purely parallel circuit configuration is depicted. In this embodiment, light strings 212 include LEDs 110 wired in a parallel configuration. Connectors 305 are mechanically and electrically connected to connectors 304. Connectors 304 are in turn each wired in parallel with connector 302. Consequently, the voltage V present at connector 302 is substantially present across each connector 304 and each LED 110. The voltage at connector 302, and elsewhere, may be an AC voltage, for example 120 VAC, 40 VAC, 30 VAC, or lower. The voltage at connector 302 may alternatively be a DC voltage (as indicated by the + and – signs at connector 302; the voltage at connector 302 and elsewhere may be any voltage desired, such as 12 VDC, 9 VDC, 3 VDC and so on, depending on voltage ratings of LEDs 110.

Referring specifically to FIG. 18, in an embodiment, LEDs 110 of light sets 212 are also wired in parallel, however, groups of connectors 304 are wired in a series configuration. In the embodiment depicted, pairs of connectors 304, such as pairs 304*a*, 304*b*, are electrically connected in a series configuration. In this embodiment, voltage V present at connector 302 is divided over a pair of connectors 304 such that voltage V/2 is present at each of connectors 305 and LEDs 110. In an embodiment, voltage V is 6 VDC, such that 3 VDC is present at connectors 305 and LEDs 110.

In another embodiment, voltage V is 9 VDC, and connectors 304 are wired three in series (not depicted), such that voltage V/3 is present at each connector 305 and LED 110. More generally, Voltage V at connector 302 is distributed over a quantity N connectors 305, such that a voltage at each LED 110 is VN.

An advantage of wiring a plurality of connectors 304 in series is that an increase in input voltage V to tree section wiring portion 206 (or 208 or 210) results in a lower current flowing through wires 300, as well as through trunk power system 304. Lower current flow is generally considered safer for users. Further, cost savings may be realized because transformers or power converters do not have to reduce incoming voltage to a level as low as that required by LEDs 110, which may be 3-5V, or some similar relatively low voltage.

Referring to FIGS. 19-28, an embodiment of an alterative connector 304/305 is depicted. As described above, light sets 212 are connected to tree frame section wiring portions via a pair of connectors 304 and 305. Connectors 304 and 305 may be considered "separate" connectors, or two halves of a connector, but in any case, serve to make an electrical and mechanical connection between light sets 212 and corresponding tree frame section wiring portions, e.g., 206 or 208 or 210.

In the embodiment depicted in FIGS. 19-28, connector 304 combines the functionality of previously described connectors 304 and 305, making a mechanical and electrical connection between the wires of light sets 212 and the wires of corresponding tree frame section wiring portions. In the embodiment depicted, connector 304 makes a connection between wires of disparate sizes, both in terms of overall diameter (a diameter that includes insulation) and in terms of conductor diameter. In an embodiment, and as depicted, light set 212 includes relatively thin single strand wires 360 and 362, which in an embodiment comprise magnet wires. In an embodiment, and also as depicted, wires 300 of first tree section wiring portion 206 comprise insulated conductors, each conductor comprising multiple conductor strands, and having both an overall wire diameter greater than either of wires 360 and 362, and also having a conductor diameter (combined conductor strands) that is greater than either of the conductors of wires 360 and 362 (conductors 366—see, FIG. 12). While reference is made to wires 300 and first tree section wiring portion 206, it will be understood that the embodiment may be applied to any tree section wiring portion, including wiring portions 208 and 210.

Embodiments of light sets 212 connected to connectors 304 facilitate the easy replacement of a single light set 212, without having to replace other light sets 212, and without having to remove or replace a branch 160.

Connector 304 provides a solution to the difficulty of mechanically connecting (and thereby electrically connecting) wires of different sizes, and avoids the need to solder wires of light set 212 to wires of wiring portion 206. Consequently, connector 304 herein may also be referred to as a disparate-wire-size connector or connector system 304.

Further, as depicted, connector 304 may also include a support-strand anchor portion, such as anchor support portion 307. However, it will be understood that embodiments of connector system 304 may not include a support-strand anchor portion.

Figures 19, 24, 25:
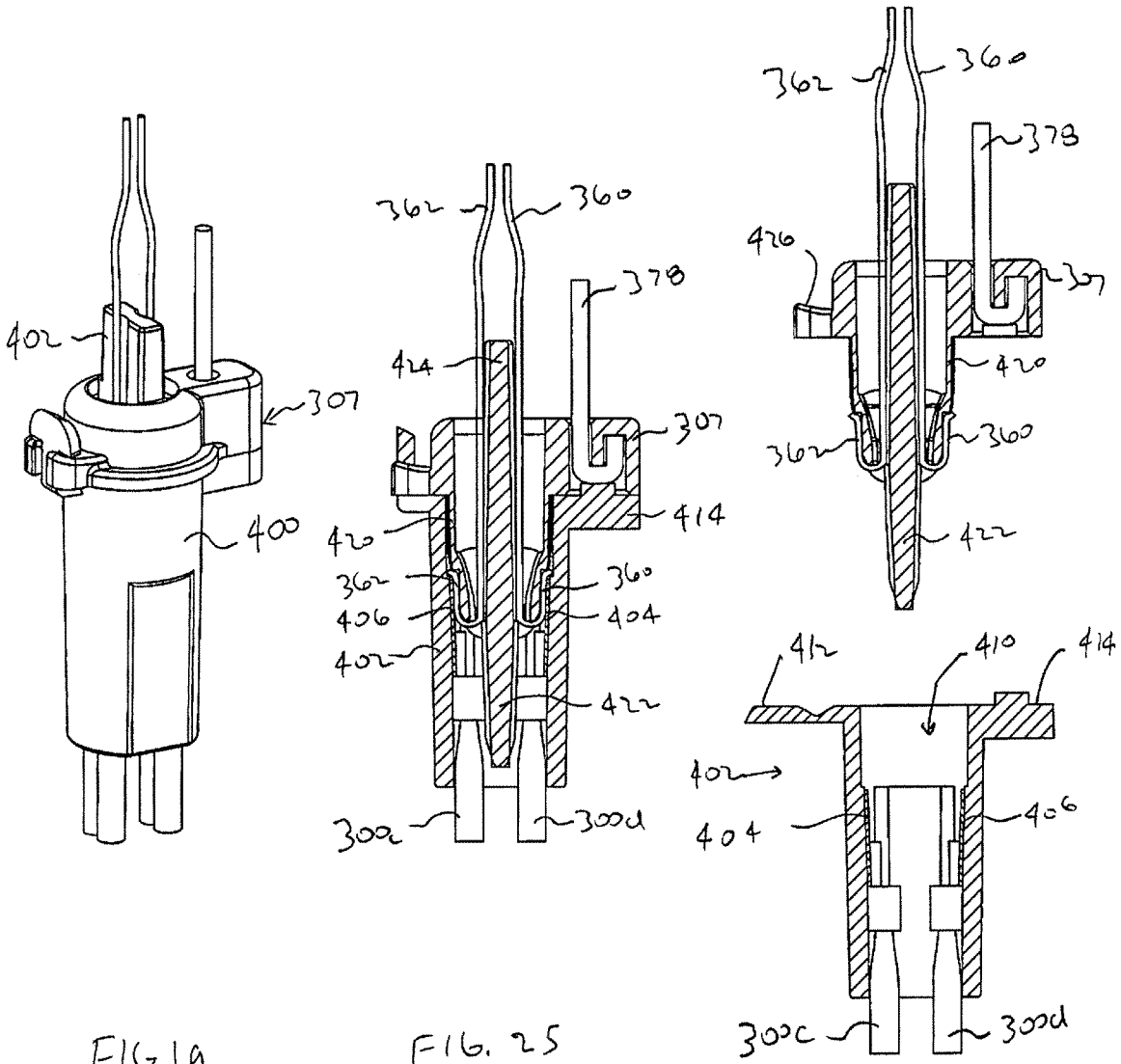
FIG. 19 is a front, perspective view of an assembled connector system, according to an embodiment.
FIG. 24 is a cross section of the partial assembly of FIG. 21, according to an embodiment.
FIG. 25 is a cross section of the assembly of FIG. 19, according to an embodiment.

Referring specifically to FIG. 19, an assembled depiction of connector system 304 is provided. In an embodiment, connector system 304 includes body portion 400, which may also be referred to as a large-wire receiver or holder, and insert 402, which may also be referred to as a small-wire receiver or holder.

Figures 20, 21, 22, 23:
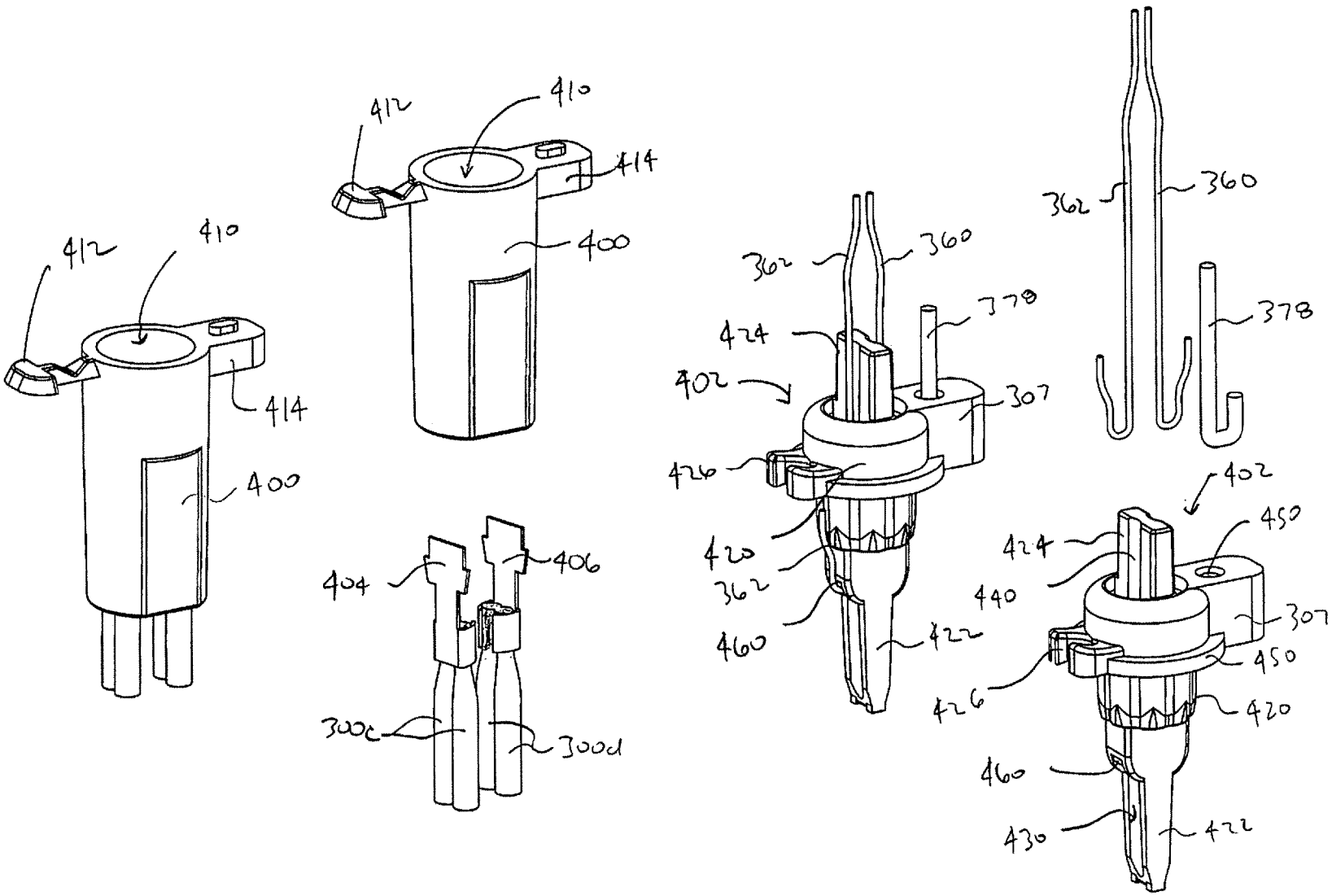
FIG. 20 is a front perspective view of wires with terminals and a connector body, according to the embodiment of FIG. 19.
FIG. 21 is a front perspective view of the wires and connector body assembled together, according to the embodiment of FIGS. 19 and 20.
FIG. 22 is a front perspective view of an insert, wires and optional support strand, according to the embodiment of FIGS. 19-22.
FIG. 23 is a front perspective view of the insert, wires and support strand, assembled together, according to the embodiment of FIG. 22.

Referring also to FIG. 20, in an embodiment, body portion 400 is configured to receive two conductive electrical terminals 404 and 406. Terminal 404, in an embodiment, is mechanically and electrically connected to one or more wires, such as intermediate wires 304*c* and 304*d*. In the embodiment depicted, terminal 404 is connected to two wires 300*c*, and terminal 406 is connected to two wires 300*d*. Such a configuration may be used when multiple connectors 304 are connected in parallel. In other embodiments, terminal 404 may be connected to only one wire, and/or terminal 406 may be connected to only one wire. When multiple connectors 304 are connected in series, terminals 404 and 406 may collectively connect to three wires.

Referring also to FIG. 21, terminals 404 and 406 are inserted into body portion 400, and a portion of each of wires 300*c* and 300*d* are received into body portion 400.

In an embodiment, body portion 400 comprises a generally cylindrical shape, defining interior cavity 410. In an embodiment, body portion 400 may also include pivoting locking tab 412 and anchor tab 414.

Referring to FIG. 22, insert 402, light set 212 wires 360 and 362, and optional support strand 378 is depicted, prior to assembly.

In an embodiment, insert 402 includes optional support-strand anchor portion 307, body portion 420, first projecting portion 422, second projecting portion 424, and optional locking tab receiver 426.

In an embodiment, first projecting portion 422, in an embodiment, forms a portion of body 420 and projects axially away from body portion 420, and defines one or more wire-receiving channels 430 for receiving a portion of wires 300*c* and 300*d*, for example, two channels 430 opposite one another (only one depicted in FIG. 22).

Second projecting portion, in an embodiment, also forms a portion of body portion 420, though in other embodiments, comprises a separately-manufactured, or non-integral part. Second projection 422 extends axially away from body portion, and may define one or more wire-receiving channels 440 for receiving wires 360 and 362, for example, two channels 440, opposite one another (only one depicted in FIG. 22).

In an embodiment, body portion 420 includes circumferential flange or ring 450, and in an embodiment, defines interior channels or openings 460 through which ends of wires 360 and 362 project. In an embodiment, ends of wires 360 and 362 are "tinned", or placed into a metal bath to remove the isolative coating of the wire, and to prepare it for contact with terminals 404 and 406.

Support strand anchor portion 307, when present, forms a tab projecting from body portion 420, and may define support-strand hole 309 for receiving a portion of support strand 378.

Referring also to FIG. 23, insert 402 assembled to wires 360 and 362, as well as support strand 378 is depicted.

Referring to FIGS. 24-25, a sectional depiction of insert 402 with wires, and a sectional depiction of body portion 400 with wires, unassembled and assembled, respectively, are depicted. In an embodiment, and as depicted, projection portion 422 and projection portion 424 form a single component. Further, when assembled, a portion of body portion 420 and projection portion 422 project into cavity 410 of body portion 402, to fit between wires 300*c* and 300*d*. Ends of wires 360 and 362 mechanically contact portions of terminals 406 and 404, respectively, thereby making an electrical connection between wires 300*c*, terminal 406 and wire 362, and also making an electrical connection between wires 300*d*, terminal 404, and wire 360.

Support strand 378 is threaded into the multiple cavities of hole 450; support-strand anchor portion 307 is fitted adjacent to portion 414. In an embodiment, a projection on portion 414 is tightly fitted into a portion of hole 450 of anchor portion 307.

Figures 26, 27, 28:
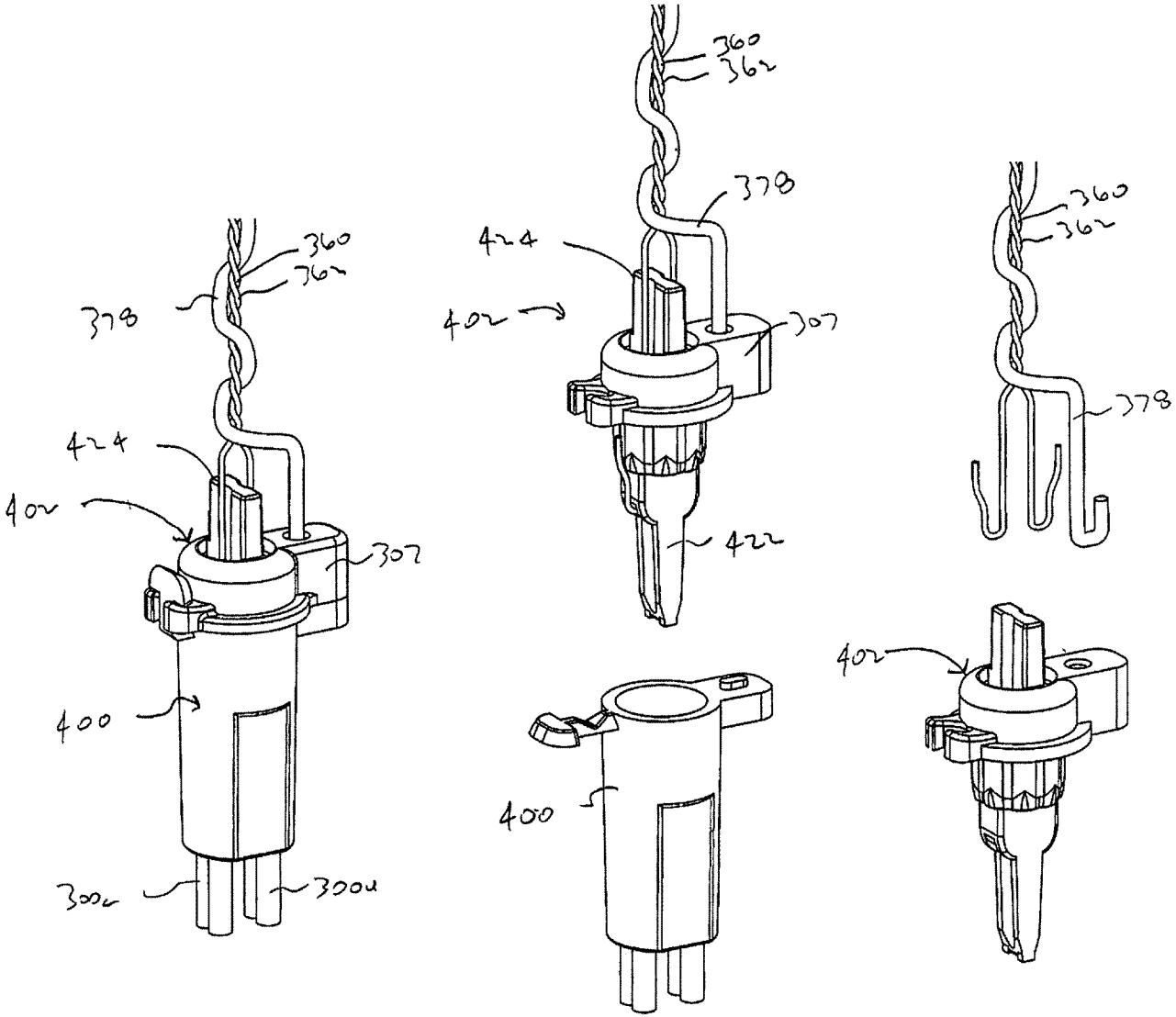
FIG. 26 is a front, perspective view of an assembled connector system, according to another embodiment having twisted wires and support strand.
FIG. 27 is a front perspective view of the connector system of FIG. 26, with the insert separated from the body portion.
FIG. 28 is a front perspective view of the wires and support strand of FIG. 26, twisted together, and separate from the insert of the connector system, according to an embodiment.

Referring also to FIGS. 26-28, an embodiment of connector system 304 is depicted. In this embodiment, all components are substantially the same as those described in FIGS. 19-25, with the exception that wires 360, 362 are twisted together, and support strand 378 is twisted about twisted wires 360 and 362.

Figure 29:
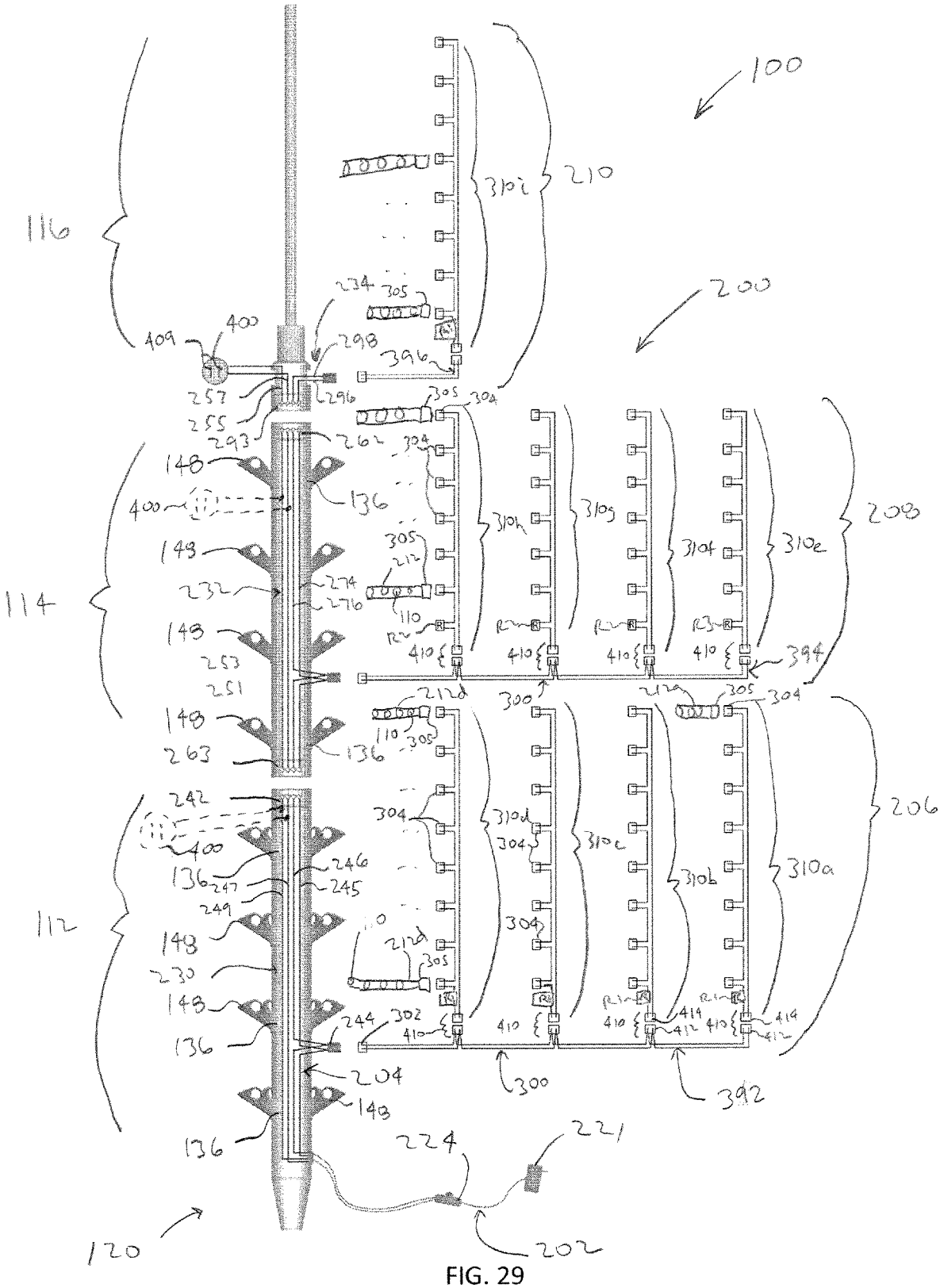
FIG. 29 is a block diagram of another embodiment of an artificial tree with a tree-lighting system, according to another embodiment.

Referring to FIG. 29, another embodiment of a tree 100 is depicted. Tree 100 of this embodiment is substantially similar to the embodiments of tree 100 described above. In the embodiment of FIG. 29, tree 100 includes a tree lighting system 200 with trunk power portion 204 having power subsystems that each include four main internal power wires, trunk electrical connectors with four terminals connected to the four main power wires, and tree section wiring portions that facilitate light sets 212 being electrically connected in series. Tree 100 of this embodiment may also include one or more accessory power receptacles.

Tree 100 includes tree frame 120 with first, second, and third tree frame sections 112, 114, and 116. Each tree frame section includes multiple branch support portions 136, each with multiple branch support arms 148. As depicted, tree frame section 112 includes four branch support portions 136 and second tree frame section 114 includes four branch support portions 136. It will be understood that more or fewer branch support portions 136 may be included for each tree section, as described above.

In an embodiment, each branch support portion 136 of first tree frame section 112 includes eight branch support arms, while each branch support portion 136 of second tree frame section 112 includes six branch support arms.

In the embodiment depicted, tree lighting system 200 includes input portion 202 with a combination plug and AC to DC power converter or transformer 221, optional switch 224 which may include a controller, and input wiring 226. In an embodiment, converter 221 converts incoming AC power from an external power source to DC power having a DC voltage output. In a wholly electrically-parallel configuration, tree lighting system 200 might include a converter that converts incoming AC power to a DC voltage that is substantially the same as the voltage appropriate for, or the rating of, the lights of light sets 212. In this embodiment, and as described further below, light and wire groups 310 may be connected in series, such that converter 221 outputs a DC voltage that is higher than the rated or operating voltage of parallel connected LEDs 110. In an embodiment, LEDs 110 of a light set 212 are electrically connected in parallel and configured to operate at 3 VDC, and converter 221 outputs 29 VDC, or 24 VDC, or 12 VDC, or another DC output voltage that is higher than the operating voltage of LEDs 110.

As will be described further below, a balancing resistor R may be utilized to accommodate a difference in a number of light strings 212 per branch support portion 136 in one tree section and associated wiring portion as compared to another, to ensure that each light set 212 receives 3 VDC.

Trunk power portion 204 includes power subsystems 230, 232 and 234 as described above, but in an embodiment, additionally includes one or more accessory power receptacles 400, and additional power wiring and electrical terminals in trunk electrical connectors for conducting power from a lower part of the tree to an upper part of tree 100. Accessory power receptacle 400 is configured to receive a power plug of an electrically-powered accessory, such as a lighted tree top ornament, or other such accessory on or near tree 100 that requires power. In an embodiment, accessory power receptacle is configured to receive and provide AC power or in other embodiments, DC power, as provided by input portion 202. In the case of an AC configuration, converter 221 provides DC power to light sets 212, but AC power from an input source or a second converter provides AC power to accessory power receptacle 400.

In an embodiment, power accessory receptacle 400 is located at, and connected to, a top tree section, such as tree frame section 116. However, as indicated in FIG. 29, other accessory power receptacles 400 may be located at a lower, middle or other tree section, as indicated in dashed lines. In an embodiment, tree 100 may include a single accessory power receptacle, such as one at a top tree section, or may include multiple accessory receptacles. In an embodiment, tree 100 includes one accessory power receptacle 400 per tree or tree frame section.

Although depicted as located apart from a trunk portion via wires extending from the tree trunk, the one or more accessory power receptacles 400 may be alternatively be connected to a wall of a trunk portion of tree 100.

In an embodiment, each accessory power receptacle 400 includes one or more fuses.

In an embodiment, each accessor power receptacle 400 is configured such that it cannot receive, or connect to, a light set 212. In one such configuration, accessory power receptacle 400 is configured with two slots 409 for receiving two blade-style terminals of a known two-blade power plug. In such a configuration, connector 305 of light set 212 includes mechanical and electrical structure that prevents insertion of connector 305 into slots 409. Such an embodiment prevents a user from attempting to power a light set 212 using accessory power receptacle 400. This may be relevant or important if power receptacle 400 presents AC power, while light sets 212 are configured to receive DC power.

In such an embodiment, first power subsystem 230 includes additional wires 247 and 249, second power subsystem 232 includes additional wires 251 and 253, and third power subsystem 230 includes additional wires 255 and 257. Trunk electrical connectors 242, 263, 262, and 293 include four electrical terminals instead of two electrical terminals. When assembled, wires 247, 251 and 255 are in electrical connection, wires 249, 253 and 257 are in electrical connection, and power is provided to accessory receptacle 400 when tree 100 is powered.

Power to light sets 212 may be provided independently of any power provided to accessory power receptacle 400. In such an embodiment, AC power is provided to accessory power receptacle 400, while DC power is provided to light sets 212.

Although a four-power-wire configuration with an accessory power receptacle 400 is depicted and described in this embodiment, it will be understood that a two-power-wire configuration, similar to the embodiment described above, may also be used in conjunction with the series connected light set configuration depicted and described herein with respect to FIG. 29.

Still referring to FIG. 29, tree lighting system 200 includes one tree section wiring portion per tree section, as described above, with multiple light sets 212 per tree section wiring portion. However, in this embodiment, while lights 110 of light sets 212 remain electrically connected in parallel, each light set 212 is electrically connected to another light set 212 in electrical series (unlike the light set to light set parallel configuration described above). Such a configuration facilitates the use of a higher voltage converter 221 in conjunction with the use of a balancing resistor R as described further below.

As described above, first tree section wiring portion 206 includes connector 302 configured to connect to lighting connector 244 at the tree trunk, and wiring 300. First tree section wiring portion 206 in this embodiment includes four light and wire groups 310, namely 310*a*, 310*b*, 310*c* and 310*d*, although it will be understood that portion 206 may include more or fewer groups 310, depending on the number of branch support portions 136 on tree frame section 112 (each group 310 corresponds to one branch support portion in a 1:1 relationship).

In the depicted embodiment, first tree section wiring portion 206 also includes an optional plurality of connector sets 410 connecting wires 300 to light and wire groups 310. Each connector set includes a first portion 412 and a second portion 414. Use of connector sets 410 to connect groups 310 to wires 300 provides manufacturing advantages relating to the manufacture of wiring portions and to their assembly on tree 100.

In an embodiment, light lighting system 200 includes branch-support-to-branch-support wiring subsystem 392 comprises connector 302, a plurality of wires 300 and a plurality of connectors 412. In an embodiment, when assembled to first tree frame section 112, wiring subsystem 392 traverses an exterior of first trunk portion 134 and extends vertically along a length of first trunk portion 134.

In an embodiment, light lighting system 200 includes branch-support-to-branch-support wiring subsystem 394 that comprises connector 302, a plurality of wires 300 and a plurality of connectors 412. In an embodiment, when assembled to second tree frame section 114, wiring subsystem 394 traverses an exterior of second trunk portion 136 and extends vertically along a length of first trunk portion 136. In an embodiment, light lighting system 200 also includes branch-support-to-branch-support wiring subsystem 396 that comprises connector 302, a plurality of wires 300 and a plurality of connectors 412. In an embodiment, when assembled to third tree frame section 116, wiring subsystem 396 traverses an exterior of third tree frame section 116.

In an alternate embodiment, wiring subsystems 392, 394 and 396 are located substantially within an interior of their respective trunk portions, with connectors 412 made accessible to light sets 212 by placement a trunk wall of a trunk portion, or exterior to their respective trunks.

As also described above, each light and wire group 310 of first tree section wiring portion 206 also includes a plurality of connector portions 304 that connect to a plurality of connector portion 305 of light sets 212. In the embodiment depicted, each wire group 310, namely 310*a*, 310*b*, 310*c* and 310*d*, each are connected to eight light sets 212 (not all light sets 212 are depicted for the sake of brevity). In this embodiment, the number of light sets 212 corresponds to the number of branch support arms 148 of each branch support portions 136. For first tree section wiring portion 206, this means that each of the four groups 310 includes eight light sets, i.e., one group per branch support portion 136, and one light set per branch support arm 148.

In this embodiment, light sets 212 associated with a group 310 are wired to one another in a series electrical connection, while lights or LEDs 110 of any particular light set 212 are wired in parallel to each other.

In certain embodiments, a resistor R may be wired in series with light sets 212 of a group 310, such as R1 for light sets 212 of first tree section wiring portion 206. A resistance value of resistor R may be selected so as to "take" or have a predetermined voltage when power is applied to light sets 212. When wired in series with light strings 212, a voltage applied to a light and wire group 210 via wires 300 and connector sets 410, and as output from converter 221, will be divided over resistor R and each light set 212. In an embodiment where all light sets are configured to operate on a voltage $V_L$ (the operating voltage of each parallel wired LED or light 110), and where there are N light sets per group (e.g., N=eight light sets 212 per group 310 for portion 206), a desired voltage drop across resistor R, $V_R$, will be equal to the output voltage $V_O$ of converter 221 minus N light sets times light voltage $V_L$, or $V_R=V_O-(N\times V_L)$.

In one such embodiment, an output voltage $V_O$ of converter 221 is 29 VDC, N=8 (eight light sets per group, or one light set for each of eight support arms), and a desired operating voltage for each light set 212 and its respective lights 110 is 3 VDC, then a desired voltage drop $V_R$ is 5 VDC. The resistance of resistor R can then be selected based on expected current flow for a group of light sets 212 (in this example, eight light sets). For example, if expected current flow is 0.25 mA per bulb, and each of the eight light sets 212 includes 50 bulbs, then total expected current flow per group 310 is 0.1 A, then a resistor R would be selected according to the property V=I×R (voltage equals current times resistance), such that the resistance of R would be 50 ohms (50 ohms=5V/0.1 A).

The use of a load-balancing resistor R in series with multiple light sets 212 creates flexibility in choosing converters 221 and flexibility in the number of light sets that can be wired in series. In the embodiment just described, a converter 221 is selected having a voltage output VO equal to 29V and a resistor R (R1) is used to drop 5 volts so as to maintain a 3 volt operating voltage at each light string 212. While resistor R could be eliminated, and a converter 221 having an output of 24 VDC could be used (24 VDC distributed across 8 light sets 212 yields the desired 3.0 VDC operating voltage for each light set), being able to choose a readily-available and possibly lower cost converter having a voltage output that does not evenly "divide out" over the light sets (e.g., 24 VDC dividing out over 8 light sets to the desired 3.0 VDC), creates manufacturing flexibility and may lower cost.

Further, the use of a resistor R in series allows flexibility in changing the number of light sets 212 per group 310 from tree section to tree section, as described further below.

A resistor R, whether R1 for first tree section wiring portion 206, or R2 for second tree section wiring portion 208, or another R, the resistor itself may be located or housed in a number of locations. In one embodiment, resistor R has its own housing and is located separate from a connector 304. In another embodiment, resistor R may be located in, or integrated into a connector 304.

Second tree section wiring portion 208 is similar to tree section wiring portion 206. However, in the embodiment depicted, each group 310 (groups 310*e*-310*h*) has fewer light sets 212 as compared to the light and wire groups 310 of tree section wiring portion 206. In the embodiment depicted, second tree frame section 114 has four branch support portions 136, and each branch support portion has six branch support arms 148 (only two per portion 136 are depicted). Consequently second tree section wiring portion 208 has four groups 310, one per branch support portion 136, and each group 310 has six light sets 212, or one light set 212 per branch support arm 148 which is the same as one light set 212 per branch.

It will be understood that the number of branch support portions 136 per tree frame section may be more or fewer than the embodiment described, and the number of branch support arms 148/branches per branch support portion 136 may also be more or fewer, depending greatly on branch construction, and desired tree branch density.

In the embodiment where lights 110 of a light set 212 are electrically connected in parallel, and light sets 212 of a group 310 are wired in series, similar to the series wiring or electrical connection of light sets 212 of a group 310 of first tree section wiring portion 206 described above, a resistor R2 is connected in electrical series to the light sets 212 so as to ensure an appropriate voltage for each light set 212 of a group 310 of wiring portion 206. In the depicted embodiment, where there are N=6 light sets per group 310, where lights or LEDs 110 are rated for, or configured to operate at, 3 VDC, and using the example again of an output voltage $V_O$ for converter 221 being 29 VDC, then a desired voltage drop $V_R$ across resistor R2 is 11 VDC. It will be noted that because the output voltage $V_O$ of converter 221 and the voltage rating of lights 110 remains the same, but the number of light sets per group changes, the required voltage drop $V_R$ increases from 5V to 11V.

A value of R2 that yields the desired voltage drop $V_R$ may be determined based on the number of lights 110 per light set 212 and expected current draw for all of the lights of a group 310, in a manner similar to that described above with respect to first tree section wiring portion 206. In this example embodiment, if the number of lights 110 per light set 212 is 40 due to branches being shorter in length in second tree frame section 114, then the number of lights 110 per group 310 is 660, and at 0.25 mA per light, total current per group 310 is 0.06 A, and R2 is 183.3 ohms, as compared to 50 ohms for R1.

A similar concept may be applied to third tree frame section 116 and its corresponding tree section wiring portion 210. In this embodiment, group 310*i* includes eight sets of lights 212, such that a value of R being equal to R1 may be used.

The above configuration and features provides a number of advantages.

To achieve a conical pine tree shape, it may be desirable to use a decreasing number of branch support arms 148 per branch support portion 136, from a bottom of tree 100 toward a top of tree 100. As described above, a lower or first tree frame section 112 may include eight branch support arms 148 per branch support portion 136, while a middle or second tree frame 114 may include fewer, such as six branch support arms 148 as in the depicted embodiment, per branch support portion 136. In an embodiment, each branch support portion 136 includes the same number of branch support arms 148, for a given tree frame section. In another embodiment, the number of branch support arms 148 per branch support portion decreases along axis A of tree 100 from bottom to top of a tree frame section. In one such embodiment, second tree frame section 114 may include eight branch support arms 148 per branch support portion 136 at a lower or bottom end that connects to first tree frame support section 112, and six branch support arms 148 per branch support portion 136 at an upper or top end that connects to third tree frame section 116.

In an embodiment, and as described above, all light sets 212 at a branch support portion 136 may be connected in series to one another. Further, one light set 212 may be used per single branch 160, such that the number of light sets 212 at one branch support portion 136, and at one height of tree 100, matches the number of branch support arms. In other words, a one-to-one relationship, light sets 212 to branch support arms 148, and hence branches 160, is present. As also described above, in some embodiments, it is advantageous to electrically connect all light sets 212 at a particular branch support portion 136 in series, and connect them electrically to a higher voltage source via a single connector set 410. In such an embodiment, the use of a load-balancing resistor enables different numbers of light sets to be connected in series for branch support portions 136 having different numbers of branch support arms 148 and branches 160, e.g., eight light sets 212 vs. six light sets, while maintaining the use of one type of light or LED 110 with a single voltage rating.

Such a configuration facilitates uniformity in the light sets 212, in the wiring scheme of tree 100 while streamlining manufacturing and assembly processes.

Embodiments of the invention described above also include methods of manufacturing and assembling a lighted tree 100.

Figure 30:
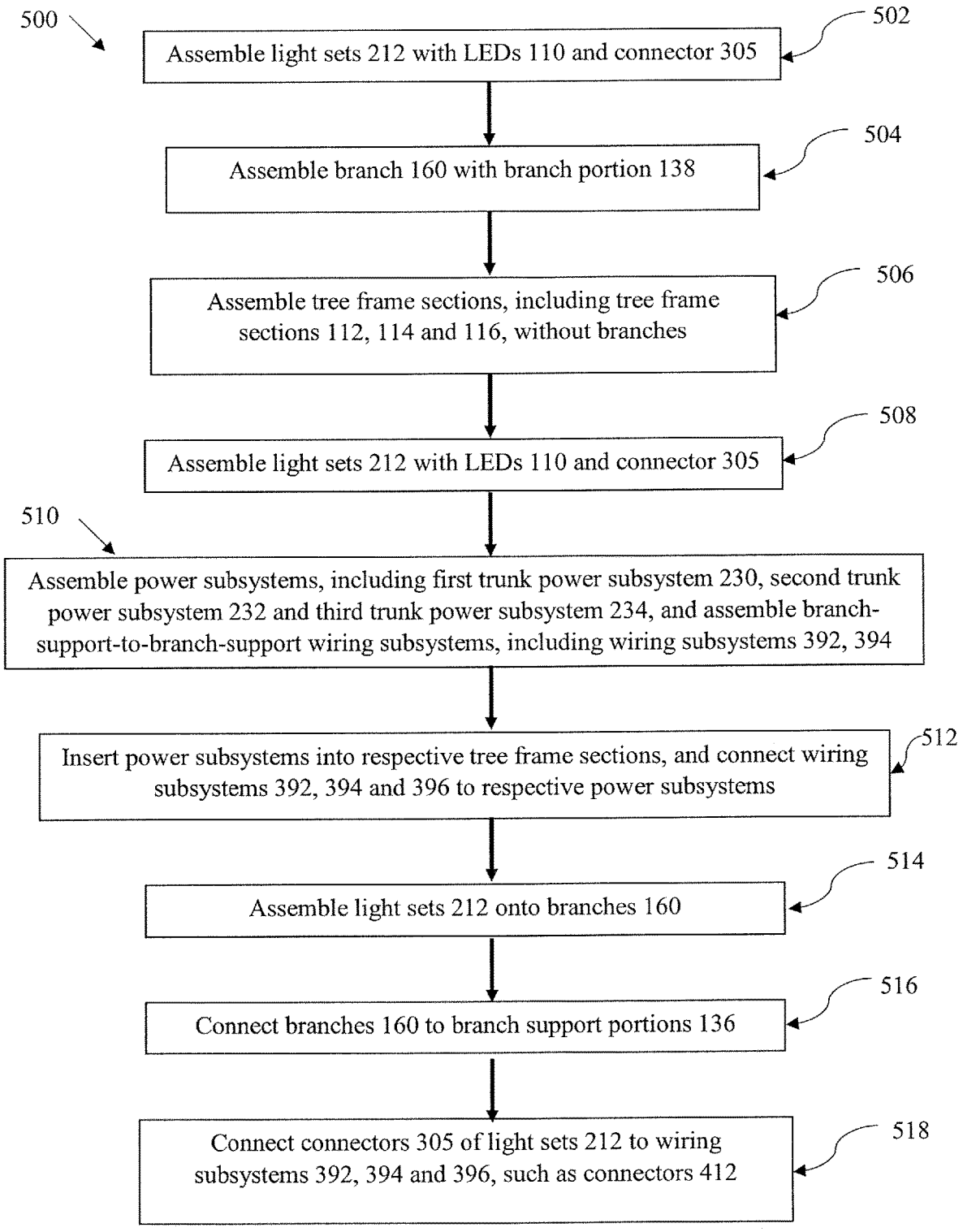
FIG. 30 is a flow diagram of a method of manufacturing a tree, according to an embodiment.

Referring to FIG. 30, in an embodiment, a method 500 of manufacturing a multi-section lighted tree 100 includes steps 502 to 518, as follows: step 502—assemble light sets 212 with LEDs 110 and connector 305; step 504—assemble branch 160 with branch portion 138; step 506—assemble tree frame sections, including tree frame sections 112, 114 and 116, without branches; step 508—assemble light sets 212 with LEDs 110 and connector 305; step 510—assemble power subsystems, including first trunk power subsystem 230, second trunk power subsystem 232 and third trunk power subsystem 234, and assemble branch-support-to-branch-support wiring subsystems, including wiring subsystems 392, 394 and 396; step 514—insert power subsystems into respective tree frame sections, and connect wiring subsystems 392, 394 and 396 to respective power subsystems; step 516—assemble light sets 212 onto branches 160; step 518—connect branches 160 to branch support portions 136; and step 520—connect connectors 305 of light sets 212 to wiring subsystems 392, 394 and 396, such as connectors 412.

Method 500 of manufacturing or assembling tree 100 differs from known assembly methods in many ways. Unlike known methods for known trees, a complete tree frame section, and usually a complete tree, is assembled, followed by adding all the light sets. However, tree 100 enables a method of assembling a tree frame section that includes putting a complete, stand-alone light set on a single branch, then connecting the branch to the branch-support portion 136 of the tree trunk. In this way, multiple lighted branches can be assembled, and tested, separately, before adding multiple light sets to an assembled tree.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, and to enable others of ordinary skill in the art to understand the embodiments disclosed herein.

What is claimed is:

1. A multi-sectional artificial tree with a tree lighting system, comprising:

a first tree section of the multi-sectional artificial tree, including:

a first tree frame section, comprising a first trunk portion defining a lengthwise axis, a first branch support portion immovably affixed to the first trunk portion at a first axial position on the first trunk portion, the first branch support portion including a first plurality of branch-receiving portions, a first plurality of branches connected to the first plurality of branch-receiving portions, each branch of the first plurality of branches including a branch shaft, the first plurality of branch-receiving portions of the first branch support portion defining a first predetermined number of branch-receiving portions, and a second branch support portion connected to the first trunk portion at a second axial position, the second axial position displaced axially from the first axial position, the second branch support portion including a second plurality of branch-receiving portions, a second plurality of branches connected to the second plurality of branch-receiving portions, each branch of the second plurality of branches including a branch shaft, the second plurality of branch-receiving portions of the second branch support portion defining a second predetermined number of branch-receiving portions;

a first trunk power subsystem including a first trunk electrical connector, and a set of first power wires electrically connected to the first trunk electrical connector;

a first tree section wiring portion of the tree lighting system in electrical connection with the first trunk electrical connector via the set of first power wires, the first tree section wiring portion comprising a first tree-section connector, a first plurality of wires connected to the first tree-section connector, a first group of light-set connectors electrically connected to the first plurality of wires, and a second group of light-set connectors electrically connected to the first plurality of wires, the first group of light-set connectors located adjacent to the first branch support portion and having a first predetermined number of light-set connectors, the first group of light-set connectors defining a first predetermined number of light-set connectors, wherein the first predetermined number of light-set connectors is the same number as the first predetermined number of branch-receiving portions, the second group of light-set connectors located adjacent to the second branch support portion, and wherein the first group of light-set connectors is electrically connected to the second group of light-set connectors by a set of group-joining wires that extends axially between the first group of light-set connectors and the second group of light-set connectors, outside of the first trunk portion;

a plurality of groups of first tree section light sets, including a first group of first tree section light sets electrically connected to the first group of light-set connectors and a second group of first tree section light sets electrically connected to the second group of light-set connectors, the first group of the plurality of groups of first tree section light sets having a first predetermined number of first tree section light sets, wherein the first predetermined number of first tree section light sets is the same number as the first predetermined number of branch-receiving portions, one of the first tree section light sets of the first group of first tree section light sets including a plurality of light-emitting diodes electrically connected to one another in parallel, another of the first tree section light sets of the first group of first tree section light sets including another plurality of light-emitting diodes electrically connected to one another in parallel, the one and other of the tree section light sets of the first group of tree section light sets electrically connected to one another in series; and a second tree section of the multi-sectional artificial tree configured to couple to the first tree section, including:

a second tree frame section, comprising a second trunk portion, a third branch support portion immovably affixed to the second trunk portion, the third branch support portion including a third plurality of branch-receiving portions, a third plurality of branches connected to the third plurality of branch-receiving portions, each branch of the third plurality of branches including a branch shaft, the third plurality of branch-receiving portions of the third branch support portion defining a third predetermined number of branch-receiving portions;

a second trunk electrical connector, the second trunk electrical connector configured to connect to the first trunk electrical connector;

a second tree section wiring portion of the tree lighting system in electrical connection with the second trunk electrical connector, the second tree section wiring portion comprising a second tree-section connector, a second plurality of wires connected to the second tree-section connector, and a third group of light-set connectors connected to the second plurality of wires, the third group of light-set connectors adjacent to the third branch support portion and having a third predetermined number of light-set connectors, wherein the third predetermined number of light-set connectors is the same number as the third predetermined number of branch-receiving portions; and a group of second tree section light sets having a predetermined number of second tree section light sets, wherein the predetermined number of second tree section light sets is the same number as the third predetermined number of branch-receiving portions.

2. The multi-sectional artificial tree of claim 1, further comprising a direct-current (DC) converter for providing DC power to the tree lighting system.

3. The multi-sectional artificial tree of claim 2, wherein the first trunk electrical connector and the second trunk electrical connector each comprise four conductive electrical terminals, two of the four conductive electrical terminals configured to conduct the DC power, and two of the four electrical terminals configured to conduct an alternating-current (AC) power.

4. The multi-sectional artificial tree claim 3, further comprising an accessory power receptacle for receiving the AC power.

5. The multi-sectional artificial tree with a tree lighting system of claim 4, wherein the accessory power receptacle defines two slots configured to receive two blade-shaped electrical terminals of an electrical accessory, and the accessory power receptacle is configured such that a connector portion of any one of the light sets of the first or the second plurality of light sets cannot be received into the two slots, thereby preventing AC power from being applied to any one of the light sets.

6. The multi-sectional artificial tree claim 2, wherein the voltage output of the power converter is 29 VDC and the operating voltage of each of the plurality of LEDs is 3 VDC.

7. The multi-sectional artificial tree of claim 1, wherein each of the first tree section light sets comprises a pair of continuous single-conductor wires.

8. The multi-sectional artificial tree of claim 1, further comprising a resistor having a predetermined resistance value electrically connected in series with the first plurality of light sets.

9. The multi-sectional artificial tree of claim 8, further comprising another resistor in electrical series with the second plurality of light sets, the predetermined resistance value of the resistor in series with the second plurality of light sets being greater than a predetermined resistance value of the resistor in series with the first plurality of lights sets so that a voltage drop across the resistor in series with the second plurality of light sets is greater than a voltage drop across the resistor in series with the first plurality of lights sets when the tree is powered.

10. The multi-sectional artificial tree of claim 1, wherein a flame-resistant insulative layer covers each conductor of each wire of the first group of first tree section light sets and the second group of first tree section light sets.

11. The multi-sectional artificial tree of claim 10, wherein each of the first plurality of branches is pivotally connected to one of the first plurality of branch-receiving portions.

12. The multi-sectional artificial tree of claim 1, wherein wires of the one of the first tree section light sets have conductors with a wire diameter that is smaller than a conductor wire diameter of any wires of the set of first power wires, and that have conductors with a wire diameter that is smaller than a conductor wire diameter of any wires of the.

13. The multi-sectional artificial tree of claim 12, wherein each light-set connector of the first group of light-set connectors is configured to receive wires having conductors of a first diameter and to receive other wires having other conductors of a second diameter, the first diameter being smaller than the second diameter.

14. The multi-sectional artificial tree of claim 1, wherein the first set of power wires extends axially inside the first trunk portion and the first trunk electrical connector is at least partially within the first trunk portion.

15. The multi-sectional artificial tree of claim 1, wherein the first trunk electrical connector and the second trunk electrical connector each comprise four conductive electrical terminals, two of the four conductive electrical terminals configured to conduct DC power, and two of the four electrical terminals configured to conduct an alternating-current (AC) power, and the tree further comprises an accessory power receptacle configured to receive the AC power.

16. The multi-sectional artificial tree of claim 1, further comprising a controller configured to provide control functions for the tree, including controlling functions of the first tree section light sets and the second tree section light sets.

17. The multi-sectional artificial tree of claim 16, wherein one of the control functions is a color-changing function that causes a color of the first tree section light sets and the second tree section light sets to change.

18. The multi-sectional artificial tree of claim 1, wherein each light set of the first tree section light sets comprises a pair of wires arranged in parallel.

19. The multi-sectional artificial tree of claim 18, wherein each light-emitting diode of the plurality of light-emitting diodes of the one of the first tree section light sets of the first group of first tree section light sets is covered by an epoxy layer.

20. The multi-sectional artificial tree of claim 19, wherein the epoxy layer contacts at least a portion of wires of the one of the first tree section light sets of the first group of first tree section light sets.

* * * * *